US010234165B2

(12) United States Patent
Zhao et al.

(10) Patent No.: US 10,234,165 B2
(45) Date of Patent: Mar. 19, 2019

(54) HVAC CONTROL SYSTEM FOR HOUSEHOLD CENTRAL AIR CONDITIONING

(71) Applicant: ZHONGSHAN BROAD-OCEAN MOTOR CO., LTD., Zhongshan (CN)

(72) Inventors: Yong Zhao, Zhongshan (CN); Ge Hu, Zhongshan (CN); Yiqiao Zhou, Zhongshan (CN); Chuping Lu, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 684 days.

(21) Appl. No.: 14/334,638

(22) Filed: Jul. 17, 2014

(65) Prior Publication Data

US 2014/0324230 A1 Oct. 30, 2014

Related U.S. Application Data

(63) Continuation-in-part of application No. PCT/CN2013/073182, filed on Mar. 26, 2013, and a (Continued)

(30) Foreign Application Priority Data

Jul. 21, 2012 (CN) ..... 2012 1 0254503
Jul. 21, 2012 (CN) ..... 2012 1 0255639

(51) Int. Cl.
*F24F 11/00* (2018.01)
*F24F 11/89* (2018.01)

(52) U.S. Cl.
CPC ..... *F24F 11/89* (2018.01)

(58) Field of Classification Search
CPC ..... F24F 11/02
(Continued)

(56) References Cited

U.S. PATENT DOCUMENTS 4,052,720 A * 10/1977 McGregor ..... G08B 13/1672 340/522
4,489,266 A * 12/1984 Franzolini ..... H02P 25/024 318/800

(Continued)

FOREIGN PATENT DOCUMENTS

CN 1071243 A 4/1993
CN 2512161 Y 9/2002

(Continued)

*Primary Examiner* — Henry T Crenshaw
(74) *Attorney, Agent, or Firm* — Matthias Scholl, PC; Matthias Scholl

(57) ABSTRACT

An HVAC control system for a household central air conditioning, including an HVAC system controller, a centrifugal blower motor, a compressor motor, and an axial fan motor. The HVAC system controller includes an HVAC microprocessor, a sensor, an interface unit for motor control, a power supply part, and a signal processing circuit. The interface unit for motor control includes an inverter unit and a rotor position detection unit. At least one of the centrifugal blower motor, the compressor motor, and the axial fan motor is a permanent magnet synchronous motor in the absence of a motor controller. The HVAC microprocessor drives the permanent magnet synchronous motor in the absence of a motor controller via the inverter unit. The rotor position detection unit sends a rotor position signal of the permanent magnet synchronous motor in the absence of a motor controller to the HVAC microprocessor.

12 Claims, 27 Drawing Sheets

Related U.S. Application Data continuation-in-part of application No. PCT/CN2013/073209, filed on Mar. 26, 2013.

(58) Field of Classification Search
USPC ..... 62/507, 505, 230, 228.1, 160, 807, 800
See application file for complete search history.

(56) References Cited

U.S. PATENT DOCUMENTS 4,799,363 A * 1/1989 Nakamura ..... F25B 13/00 62/160
4,912,378 A * 3/1990 Vukosavic ..... H02P 6/187 318/400.04
5,344,069 A * 9/1994 Narikiyo ..... F24F 3/001 165/207
5,834,918 A * 11/1998 Taylor ..... H02P 6/34 318/601
5,969,498 A * 10/1999 Cooke ..... H02P 27/08 318/799
6,065,298 A * 5/2000 Fujimoto ..... F24F 11/008 62/129
6,305,187 B1 * 10/2001 Tsuboe ..... F04C 29/0014 62/196.3
6,311,511 B1 * 11/2001 Maeda ..... F24F 3/1411 62/271
6,464,000 B1 10/2002 Kloster
2004/0070300 A1 * 4/2004 Fu ..... H02K 1/278 310/156.47
2004/0159115 A1 * 8/2004 Matsunaga ..... F04C 18/0215 62/228.1
2005/0012490 A1 * 1/2005 Ueda ..... H02P 27/08 318/807
2005/0159847 A1 * 7/2005 Shah ..... G05B 15/02 700/276
2007/0006602 A1 * 1/2007 Hayashi ..... F24D 19/1072 62/190
2007/0051119 A1 * 3/2007 Hayashi ..... F25B 5/02 62/183
2008/0110189 A1 * 5/2008 Alston ..... B60H 1/00428 62/236
2008/0129243 A1 * 6/2008 Nashiki ..... H02K 1/145 318/701
2010/0186441 A1 * 7/2010 Lee ..... F24F 1/20 62/507
2011/0068724 A1 * 3/2011 Henderson ..... H02P 6/18 318/400.21
2011/0238224 A1 * 9/2011 Schnell ..... F24F 11/006 700/278

FOREIGN PATENT DOCUMENTS

CN 1373550 A 10/2002
CN 1455193 A 11/2003
CN 1588793 A 3/2005
CN 201072207 Y 6/2008
CN 201181060 Y 1/2009
CN 101464032 A 6/2009
CN 202014219 U 10/2011
CN 102400899 A 4/2012
CN 102457225 A 5/2012
CN 102748834 A 10/2012
CN 102748835 A 10/2012
CN 102769418 A 11/2012
CN 102769419 A 11/2012
JP S57-175416 A 10/1982
JP 2005-086911 A 3/2005
JP 2010-259132 A 11/2010
JP 2011-188568 A 9/2011
JP 2012-138982 A 7/2012

* cited by examiner

HVAC CONTROL SYSTEM FOR HOUSEHOLD CENTRAL AIR CONDITIONING

CROSS-REFERENCE TO RELATED APPLICATIONS

This application is a continuation-in-part of International Patent Application No. PCT/CN2013/073182 with an international filing date of Mar. 26, 2013, designating the United States, now pending, and further claims priority benefits to Chinese Patent Application No. 201210254503.2 filed Jul. 21, 2012, and is also a continuation-in-part of International Patent Application No. PCT/CN2013/073209 with an international filing date of Mar. 26, 2013, designating the United States, now pending, and further claims priority benefits to Chinese Patent Application No. 201210255639.5 filed Jul. 21, 2012. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to an HVAC control system for a household central air conditioning.

Description of the Related Art

A typical HVAC control system for a household central air conditioning having an integrated structure, as shown in FIGS. 1-2, includes: an HVAC system controller, a centrifugal blower motor, a compressor motor, an axial fan motor, and a gas induced draft fan motor. The four motors are controlled by the HVAC system controller. An HVAC microprocessor is connected to motor controllers via an interface unit for motor control.

Another typical HVAC control system for a household central air conditioning having a fission structure, as shown in FIGS. 3-4, includes: an indoor controller including a first microprocessor, and an outdoor controller including a second microprocessor. A centrifugal blower motor is controlled by the indoor controller, and a compressor motor and an axial fan motor are controlled by the outdoor controller. As shown in FIG. 5, the first microprocessor and the second microprocessor are connected to the motor controllers via interface units for motor control, respectively.

However, in the above HVAC control systems, the centrifugal blower motor and the compressor motor are permanent magnet synchronous motors provided with independent motor controllers, respectively; and each independent motor controller includes: a power supply part, a microprocessor, an inverter circuit, and a detection unit for operating parameters. Thus, the configuration of the whole circuit of the control part is overlapped, thereby sophisticating the structure, and neither the hardware resource nor the software resource of the HVAC system controller, the indoor controller, or the outdoor controller is fully utilized, thereby directly causing large decrease in production cost and resource waste. Furthermore, the heat dissipation has become a tough issue since the layout space for the motor controllers is very limited.

SUMMARY OF THE INVENTION

In view of the above-described problems, it is one objective of the invention to provide a first HVAC control system for a household central air conditioning that utilizes permanent magnet synchronous motors in the absence of a motor controller. Inverter units and rotor position detection units of the permanent magnet synchronous motors are integrated inside the HVAC system controller. The HVAC microprocessor cooperates with the inverter units and the rotor position detection units to control the permanent magnet synchronous motors in the absence of a motor controller, so that the overlapped circuit configurations are deleted, the circuit structure is simplified, and the production cost and the resource waste are decreased.

It is another objective of the invention to provide a second HVAC control system for a household central air conditioning that utilizes the permanent magnet synchronous motors in the absence of a motor controller. Inverter units and rotor position detection units of the permanent magnet synchronous motors are integrated inside a first controller for an indoor unit and a second controller for an outdoor unit. A first microprocessor, a second microprocessor, the inverter units, and the rotor position detection units are cooperated to control the permanent magnet synchronous motors in the absence of a motor controller, so that overlapped circuit configurations are deleted, the circuit structure is simplified, and the production cost and the resource waste are decreased.

To achieve the above objective, in accordance with one embodiment of the invention, there is provided a first HVAC control system for a household central air conditioning, the HVAC control system comprising: an HVAC system controller; a centrifugal blower motor; a compressor motor; and an axial fan motor. The HVAC system controller comprises: an HVAC microprocessor, a sensor, an interface unit for motor control, a power supply part, and a signal processing circuit. The interface unit for motor control comprises: an inverter unit and a rotor position detection unit. The power supply part supplies power to each circuit part. The sensor sends a detected signal to the HVAC microprocessor via the signal processing circuit. At least one of the centrifugal blower motor, the compressor motor, and the axial fan motor is a permanent magnet synchronous motor in the absence of a motor controller. The HVAC microprocessor drives the permanent magnet synchronous motor in the absence of a motor controller via the inverter unit. The rotor position detection unit sends a rotor position signal of the permanent magnet synchronous motor in the absence of a motor controller to the HVAC microprocessor.

In a class of this embodiment, the centrifugal blower motor is the permanent magnet synchronous motor in the absence of a motor controller; and the compressor motor and the axial fan motor are AC motors.

In a class of this embodiment, the compressor motor is the permanent magnet synchronous motor in the absence of a motor controller; and the centrifugal blower motor and the axial fan motor are AC motors.

In a class of this embodiment, the axial fan motor is the permanent magnet synchronous motor in the absence of a motor controller; and the compressor motor and the centrifugal blower motor are AC motors.

In a class of this embodiment, the centrifugal blower motor and the compressor motor are the permanent magnet synchronous motors in the absence of a motor controller; and the axial fan motor is an AC motor.

In a class of this embodiment, the centrifugal blower motor and the axial fan motor are the permanent magnet synchronous motors in the absence of a motor controller; and the compressor motor is an AC motor.

In a class of this embodiment, the compressor motor and the axial fan motor are the permanent magnet synchronous motors in the absence of a motor controller; and the centrifugal blower motor is an AC motor.

In a class of this embodiment, the centrifugal blower motor, the axial fan motor, and the compressor motor are all permanent magnet synchronous motors in the absence of a motor controller.

In a class of this embodiment, the HVAC control system is further connected to a gas induced draft fan motor; and the gas induced draft fan motor is the AC motor or the permanent magnet synchronous motor in the absence of a motor controller.

In a class of this embodiment, the rotor position detection unit is a phase current detection circuit.

In a class of this embodiment, the interface unit for motor control further comprises at least one relay and a drive circuit thereof. The HVAC microprocessor is connected to the AC motor via the relay and the drive circuit thereof.

In accordance with another embodiment of the invention, there is provided with a second HVAC control system for a household central air conditioning. The second HVAC control system comprises: a first controller for indoor unit, a second controller for outdoor unit, a centrifugal blower motor, a compressor motor, and an axial fan motor. The first controller comprises: a first microprocessor, a sensor, a first interface unit for motor control, a first power supply part, and a signal processing circuit. The second controller comprises: a second microprocessor, a second interface unit for motor control, and a second power supply part. Both the first interface unit for motor control and the second interface unit for motor control comprise at least one inverter unit and one rotor position detection unit. The first power supply part supplies power to each circuit part of the first controller. The sensor sends a detected signal to the first microprocessor via the signal processing circuit. The second power supply part supplies power to each circuit part of the second controller. The second microprocessor controls the compressor motor and the axial fan motor via the second interface unit for motor control. The first microprocessor controls the centrifugal blower motor via the first interface unit for motor control. At least one of the centrifugal blower motor, the compressor motor, and the axial fan motor is the permanent magnet synchronous motor in the absence of a motor controller. The first microprocessor or the second microprocessor drives the permanent magnet synchronous motor in the absence of a motor controller via the inverter unit. The rotor position detection unit sends a rotor position signal of the permanent magnet synchronous motor in the absence of a motor controller to the first microprocessor or the second microprocessor.

In a class of this embodiment, the centrifugal blower motor is the permanent magnet synchronous motor in the absence of a motor controller; and the compressor motor and the axial fan motor are AC motors.

In a class of this embodiment, the compressor motor is the permanent magnet synchronous motor in the absence of a motor controller; and the centrifugal blower motor and the axial fan motor are AC motors.

In a class of this embodiment, the axial fan motor is the permanent magnet synchronous motor in the absence of a motor controller; and the compressor motor and the centrifugal blower motor are AC motors.

In a class of this embodiment, the centrifugal blower motor and the compressor motor are the permanent magnet synchronous motors in the absence of a motor controller; and the axial fan motor is an AC motor.

In a class of this embodiment, the centrifugal blower motor and the axial fan motor are the permanent magnet synchronous motors in the absence of a motor controller; and the compressor motor is an AC motor.

In a class of this embodiment, the compressor motor and the axial fan motor are the permanent magnet synchronous motors in the absence of a motor controller; and the centrifugal blower motor is an AC motor.

In a class of this embodiment, the centrifugal blower motor, the axial fan motor, and the compressor motor are all permanent magnet synchronous motors in the absence of a motor controller.

In a class of this embodiment, the first microprocessor is further connected to a gas induced draft fan motor. The gas induced draft fan motor is the AC motor or the permanent magnet synchronous motor in the absence of a motor controller.

In a class of this embodiment, the rotor position detection unit is a phase current detection circuit.

In a class of this embodiment, each of the first interface unit for motor control and the second interface unit for motor control further comprises at least one relay and a drive circuit thereof. The first microprocessor or the second microprocessor is connected to the AC motor via the relay and the drive circuit thereof.

Advantages according to embodiments of the invention are summarized as follows:

1) The HVAC system controller of the first HVAC control system comprises: the HVAC microprocessor, the interface unit for motor control, and the power supply part. The power supply part supplies power to each circuit part. At least one of the centrifugal blower motor, the compressor motor, and the axial fan motor is the permanent magnet synchronous motor in the absence of a motor controller. The interface unit for motor control comprises: the inverter unit and the rotor position detection unit. The HVAC microprocessor drives the permanent magnet synchronous motor in the absence of a motor controller via the inverter unit. The rotor position detection unit sends the rotor position signal of the permanent magnet synchronous motor in the absence of a motor controller to the HVAC microprocessor. It only needs one power supply part to supply power, so that the configuration of the independent power supply for each of the original motor controller is deleted, thereby simplifying the circuit structure. The inverter unit and the rotor position detection unit of the permanent magnet synchronous motor are integrated inside the HVAC system controller. The HVAC microprocessor cooperates with the inverter unit and the rotor position detection unit to control the permanent magnet synchronous motor in the absence of a motor controller, so that the overlapped circuit configurations are deleted. The microprocessor of the original motor controller is substituted by the HVAC microprocessor, thus, the circuit structure is simplified, and the production cost and the resource waste are largely decreased. Besides, the heat dissipation condition of the HVAC system controller is relatively good, thereby tackling the unstable control problem resulting from the poor heat dissipation in the original motor controller.

2) At least two or all of the centrifugal blower motor, the compressor motor, and the axial fan motor are permanent magnet synchronous motors in the absence of a motor controller, so that the energy-saving effect is enhanced, the circuit structure is simplified, and the production cost is decreased, thereby meeting the requirement of the users.

3) The rotor position detection unit is the phase current detection circuit that is capable of utilizing the phase current to calculate the rotor position and simplifying the circuit and the connection by the vector control, thereby saving the production cost.

4) The first HVAC control system is further connected to the gas induced draft fan motor. The gas induced draft fan motor is the permanent magnet synchronous motor in the absence of a motor controller, so that the energy-saving effect is enhanced, the circuit structure is simplified, and the production cost is decreased, thereby meeting the requirement of the users.

5) In the second HVAC control system, the first controller comprises: the first microprocessor, the sensor, the first interface unit for motor control, and the first power supply part. The second controller comprises: the second microprocessor, the second interface unit for motor control, and the second power supply part. The second microprocessor controls the compressor motor and the axial fan motor via the second interface unit for motor control. The first microprocessor controls the centrifugal blower motor via the first interface unit for motor control. At least one of the centrifugal blower motor, the compressor motor, and the axial fan motor is the permanent magnet synchronous motor in the absence of a motor controller. Both the first interface unit for motor control and the second interface unit for motor control comprise at least one inverter unit and one rotor position detection unit. The first microprocessor or the second microprocessor drives the permanent magnet synchronous motor in the absence of a motor controller via the inverter unit. The rotor position detection unit sends the rotor position signal of the permanent magnet synchronous motor in the absence of a motor controller to the first microprocessor or the second microprocessor. The configuration of the independent power supply for each of the original motor controller is deleted, so that the circuit structure is simplified. The inverter unit and the rotor position detection unit of the permanent magnet synchronous motor are integrated inside the first microprocessor and the second microprocessor. The first microprocessor and the second microprocessor cooperate with the inverter unit and the rotor position detection unit to control the permanent magnet synchronous motor in the absence of a motor controller, so that the overlapped circuit configurations are deleted. The microprocessor of the original motor controller is substituted by the first microprocessor and the second microprocessor, thus, the circuit structure is simplified, and the production cost and the resource waste are largely decreased. Besides, the heat dissipation condition of the first microprocessor or the second microprocessor is relatively good, thereby tackling the unstable control problem resulting from the poor heat dissipation in the original motor controller.

6) The second HVAC control system is further connected to the gas induced draft fan motor. The gas induced draft fan motor is the permanent magnet synchronous motor in the absence of a motor controller, so that the energy-saving effect is enhanced, the circuit structure is simplified, and the production cost is decreased, thereby meeting the requirement of the users.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing HVAC control systems for household central air conditionings are described below. It should be noted that the following examples are intended to describe and not to limit the invention.

Example 1

Figure 1:
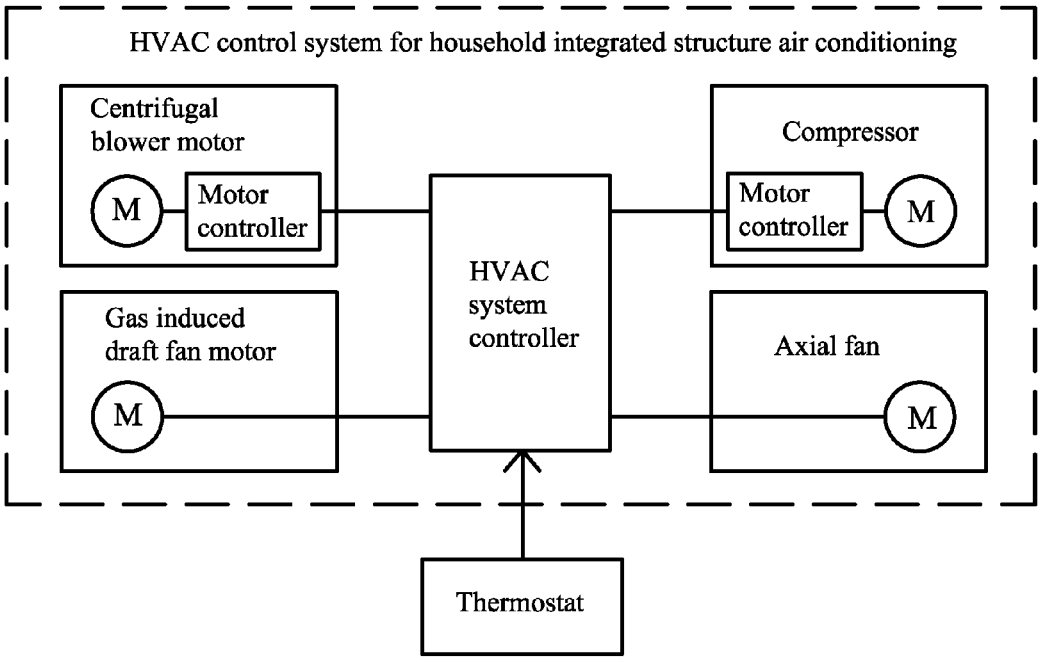
FIG. 1 (Prior art)
FIG. 1 is a schematic diagram of a conventional HVAC control system for a household central air conditioning having an integrated structure.
Figure 2:
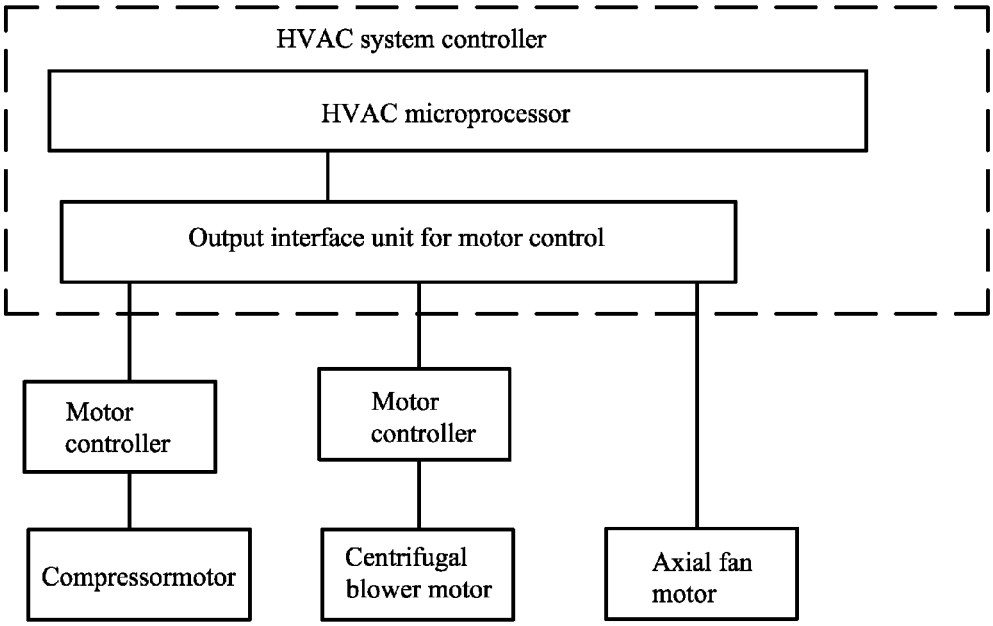
FIG. 2 (Prior art)
FIG. 2 is a block diagram of FIG. 1.
Figure 3:
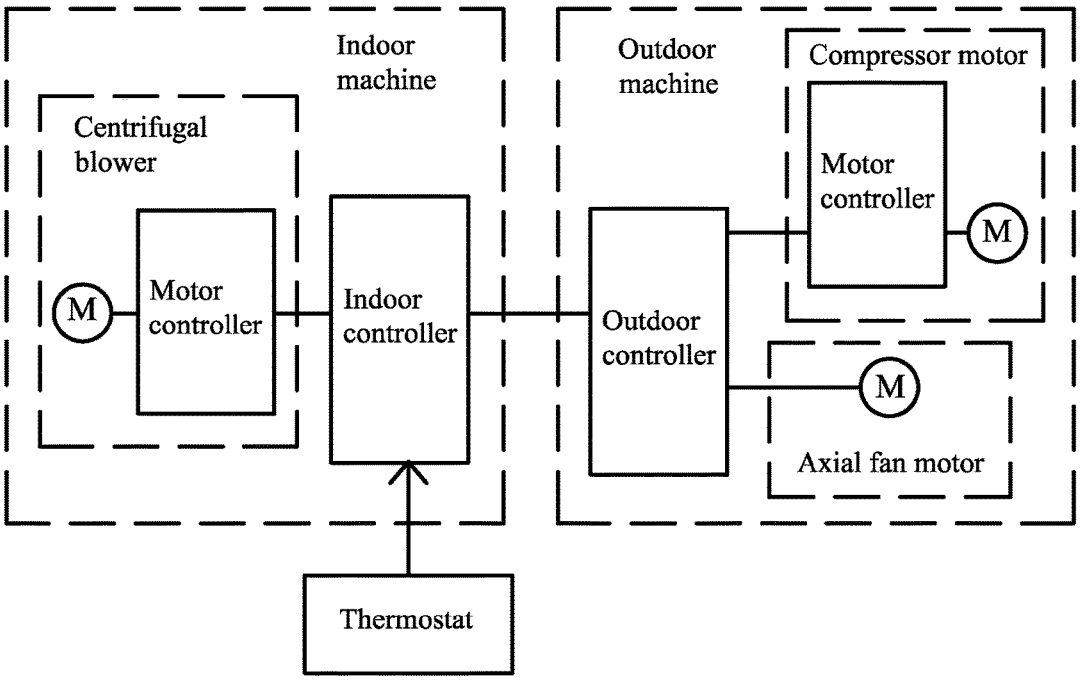
FIG. 3 (Prior art)
FIG. 3 is a first schematic diagram of a conventional HVAC control system for a household central air conditioning having a fission structure.
Figure 4:
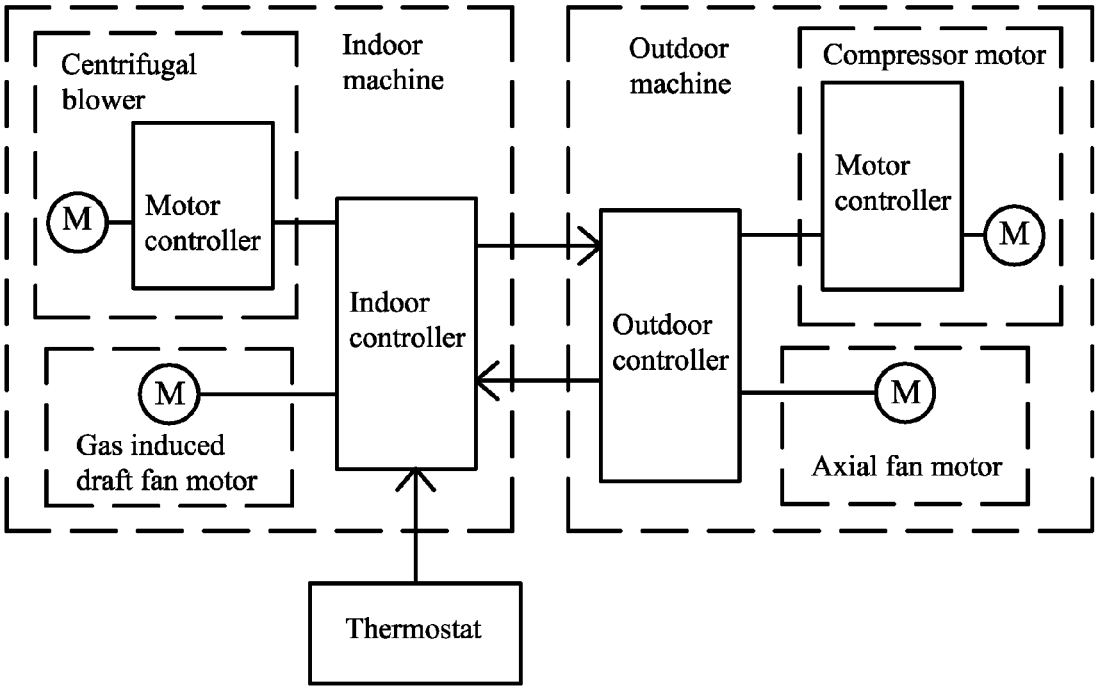
FIG. 4 (Prior art)
FIG. 4 is a second schematic diagram of a conventional HVAC control system for a household central air conditioning having a fission structure.
Figure 5:
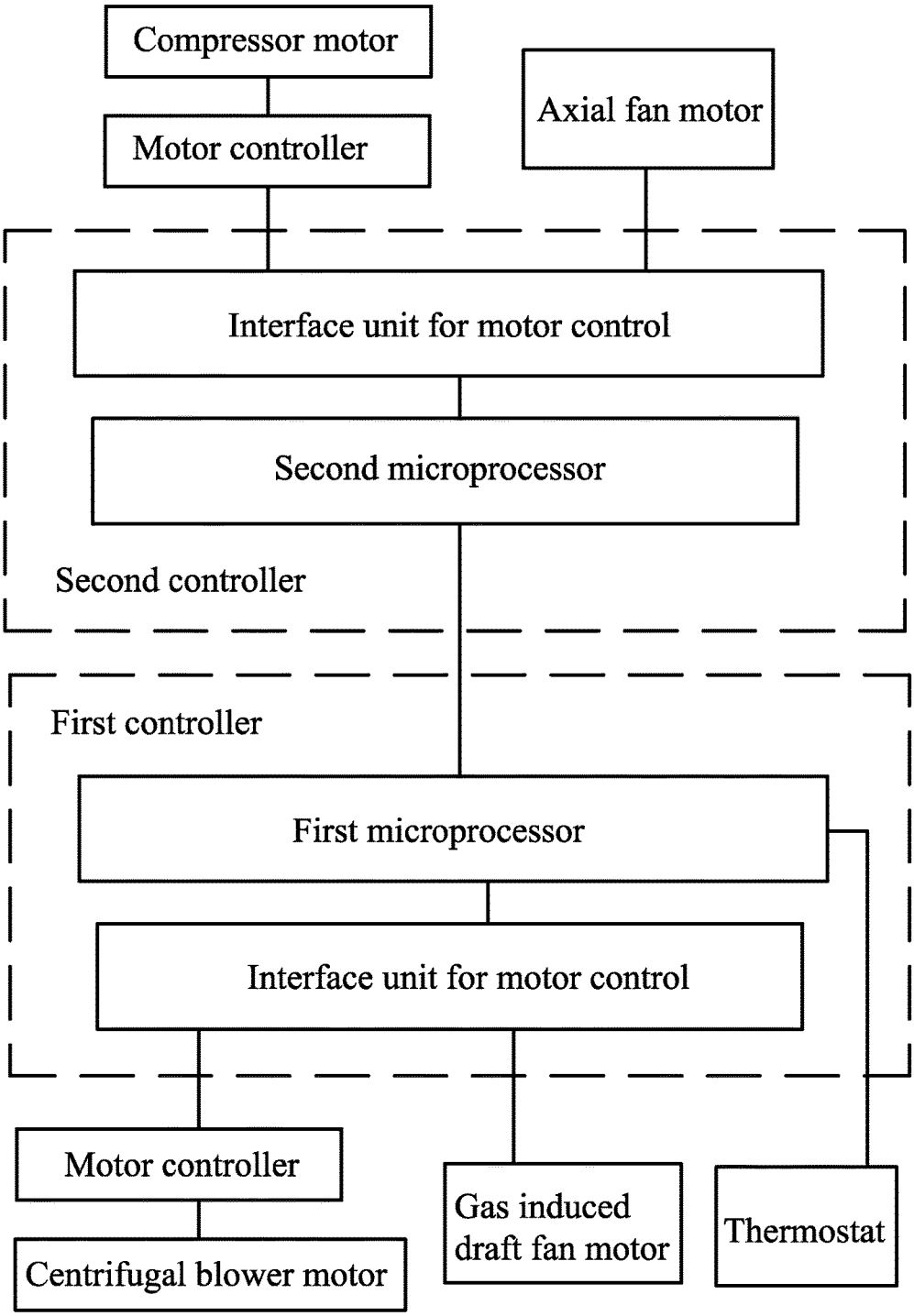
FIG. 5 (Prior art)
FIG. 5 is a block diagram of FIG. 4.
Figure 6:
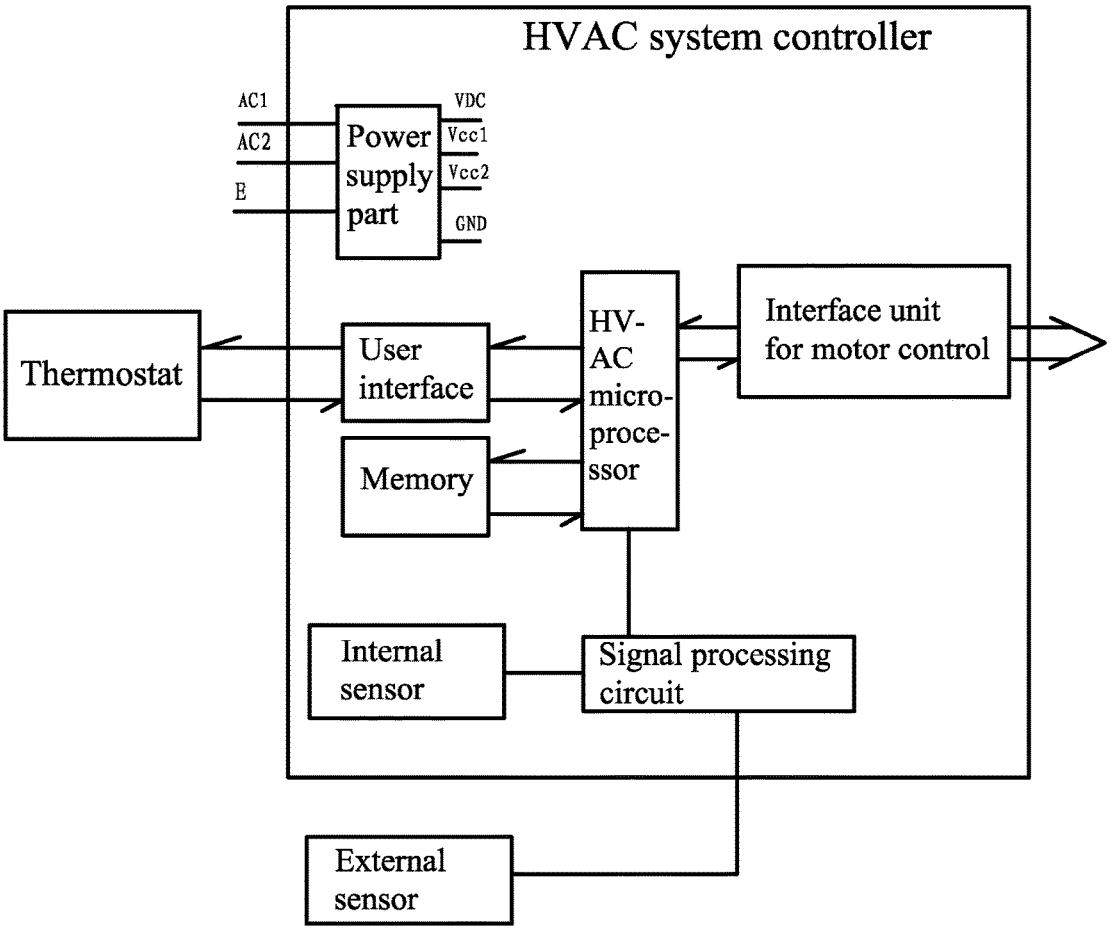
FIG. 6 is a first circuit block diagram of an HVAC control system for a household central air conditioning according to one embodiment of the invention.
Figure 7:
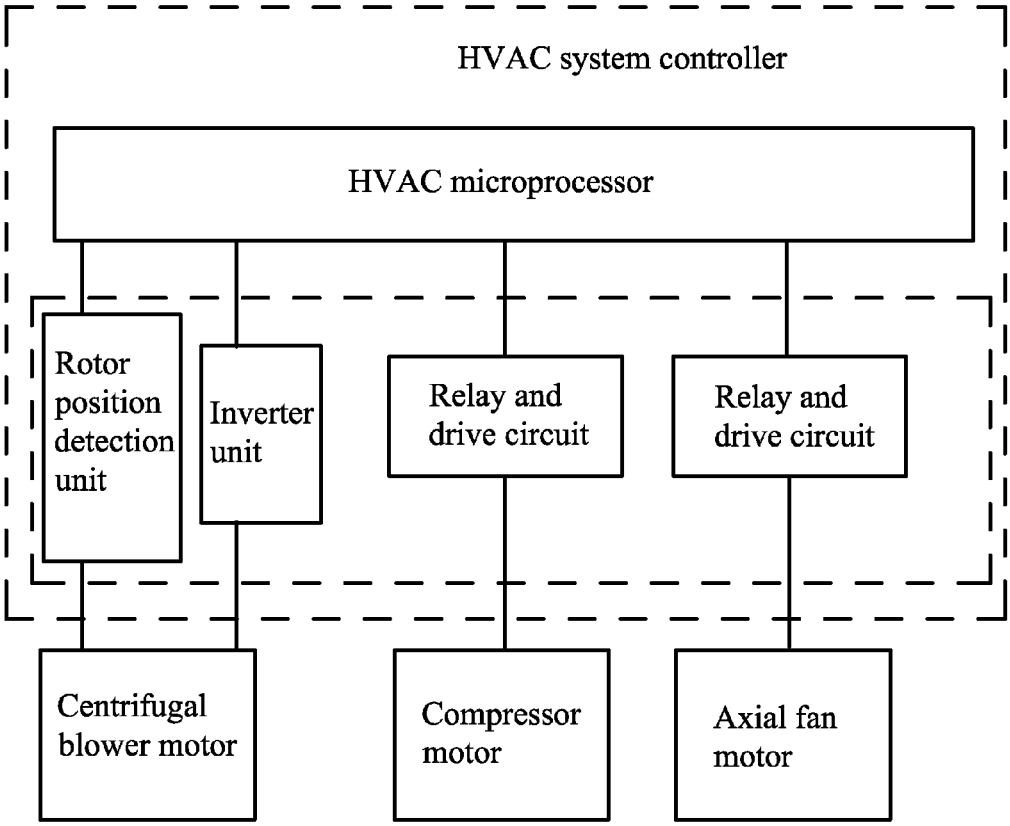
FIG. 7 is a first specific block diagram of FIG. 6.

As shown in FIGS. 6-7, an HVAC control system for a household central air conditioning comprises: an HVAC system controller, a centrifugal blower motor, a compressor motor, and an axial fan motor. The HVAC system controller comprises: an HVAC microprocessor, an internal sensor, an external sensor, a memory, a signal processing circuit, a user interface, an interface unit for motor control, and a power supply part. The power supply part supplies power to each circuit part. The internal sensor and the external sensor send detected signals to the HVAC microprocessor via the signal processing circuit. The compressor motor is a permanent magnet synchronous motor in the absence of a motor controller while the centrifugal blower motor and the axial fan motor are AC motors. The interface unit for motor control comprises: an inverter unit, a rotor position detection unit, and two relays and drive circuits thereof. The HVAC microprocessor drives the permanent magnet synchronous motor in the absence of a motor controller via the inverter unit. The rotor position detection unit sends a rotor position signal of the permanent magnet synchronous motor in the absence of a motor controller to the HVAC microprocessor. A thermostat is connected to the HVAC microprocessor for communication via the user interface. The HVAC microprocessor controls the centrifugal blower motor and the axial fan motor via the two relays and the drive circuits thereof.

Figure 8:
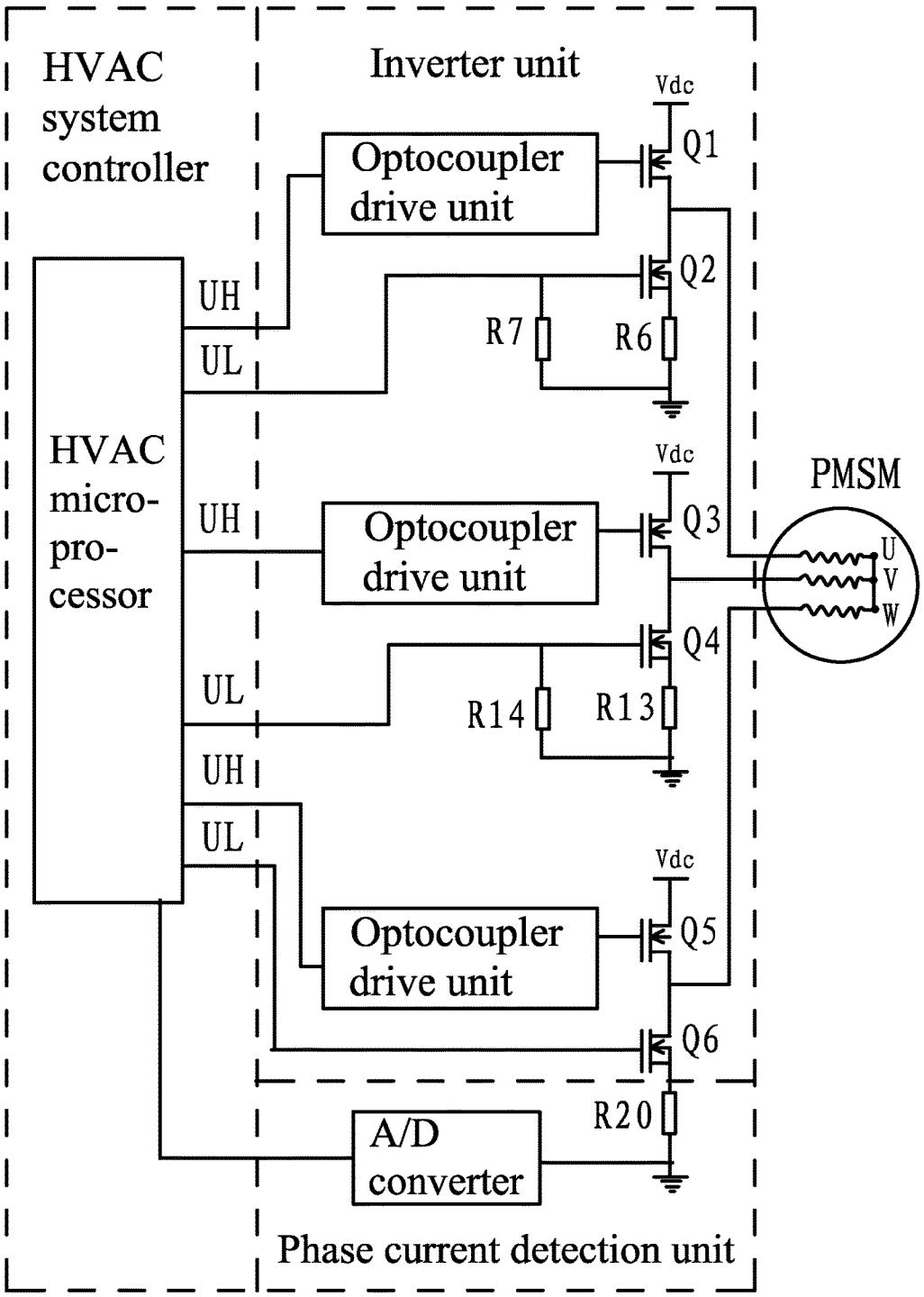
FIG. 8 is a first circuit diagram showing an inverter unit and a rotor position detection unit of an HVAC control system according to one embodiment of the invention.

As shown in FIG. 8, the permanent magnet synchronous motor in the absence of a motor controller is controlled by the HVAC microprocessor. Rotor position detection unit is a phase current detection unit. The phase current detection unit primarily comprises a resistance R20. A vector control mode without position sensor is employed to only detect the phase current of a motor winding and calculate the rotor position. A plurality of IGBT switches Q1, Q2, Q3, Q4, Q5, and Q6 of the inverter circuit are utilized to control the current of the motor winding. Therefore, the circuit structure and the connection are simplified, the detected signals are decreased, and the production cost is further reduced.

The HVAC control system according to Example 1 can be applied in the household central air conditioning having an integrated structure or that having a fission structure and including an indoor unit and an outdoor unit with a common distance of 25 meters below.

Example 2

Figure 9:
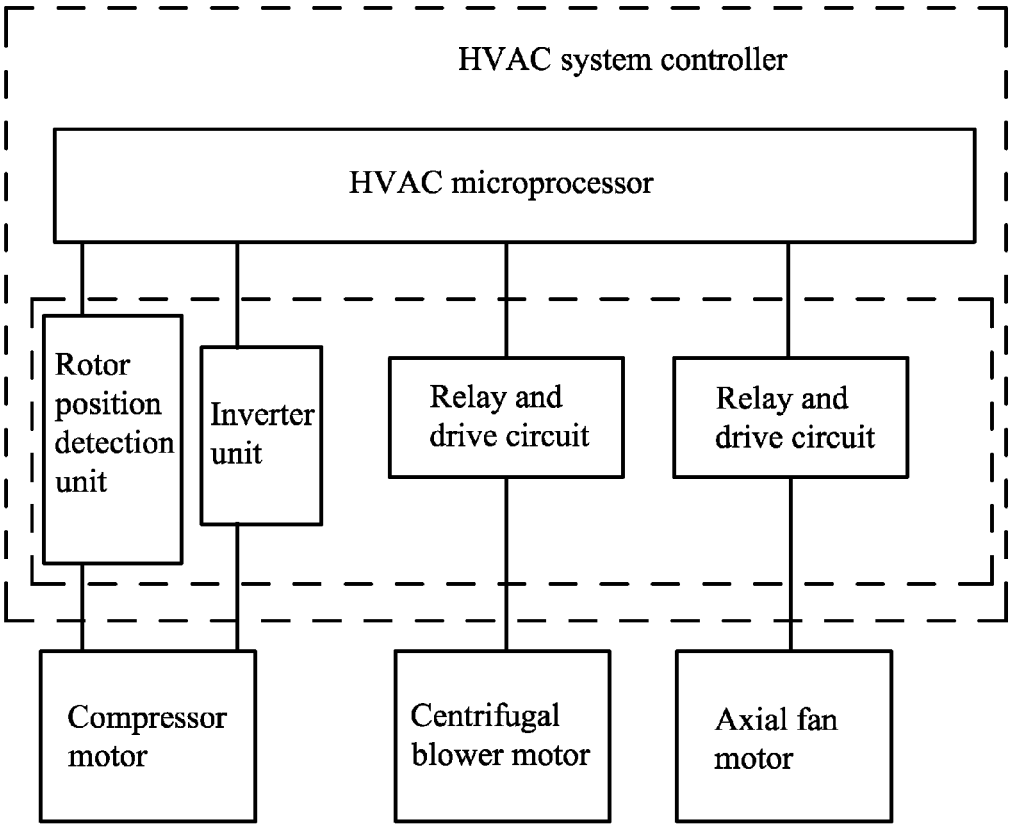
FIG. 9 is a second specific block diagram of FIG. 6.

As shown in FIG. 9, an HVAC control system is the same as that of Example 1 except that the centrifugal blower motor is the permanent magnet synchronous motor in the absence of a motor controller while the compressor motor and the axial fan motor are the AC motors. The interface unit for motor control comprises: an inverter unit, a rotor position detection unit, and two relays and drive circuits thereof. The HVAC microprocessor drives the permanent magnet synchronous motor in the absence of a motor controller via the inverter unit. The rotor position detection unit sends a rotor position signal of the permanent magnet synchronous motor in the absence of a motor controller to the HVAC microprocessor. The HVAC microprocessor controls the compressor motor and the axial fan motor via the two relays and the drive circuits thereof.

Example 3

Figure 10:
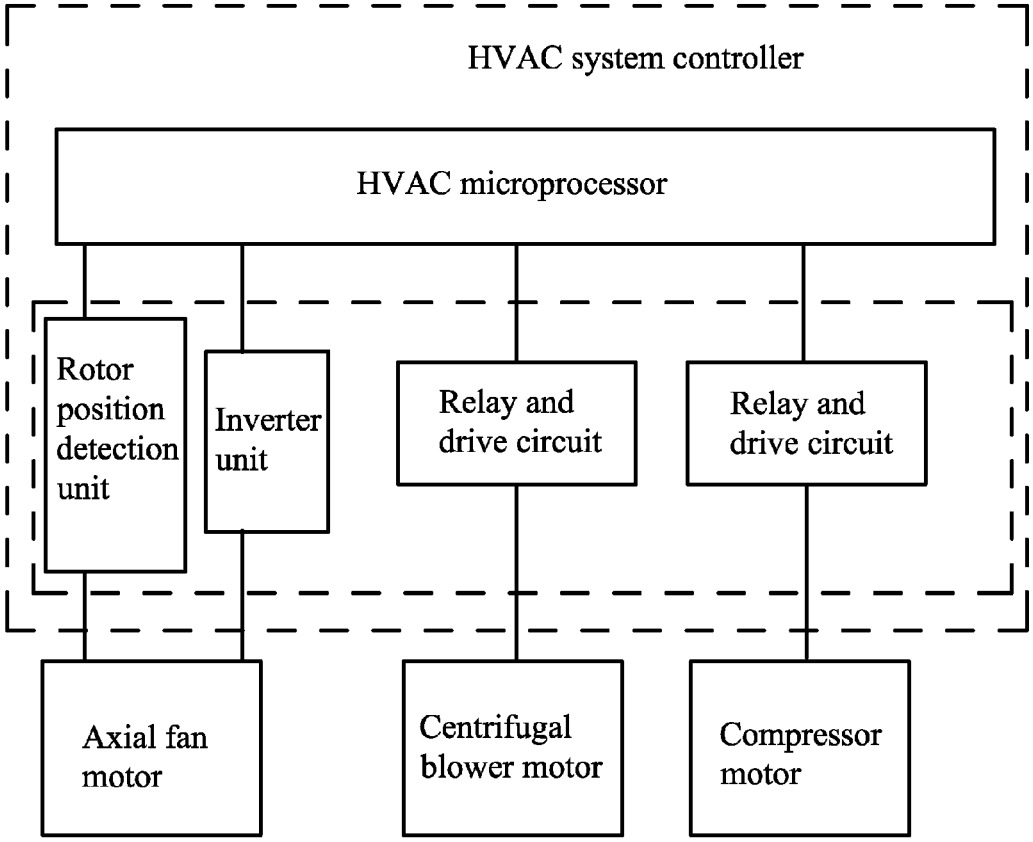
FIG. 10 is a third specific block diagram of FIG. 6.

As shown in FIG. 10, an HVAC control system is the same as that of Example 1 except that the axial fan motor is the permanent magnet synchronous motor in the absence of a motor controller while the compressor motor and the centrifugal blower motor are the AC motors. The interface unit for motor control comprises: an inverter unit, a rotor position detection unit, and two relays and drive circuits thereof. The HVAC microprocessor drives the permanent magnet synchronous motor in the absence of a motor controller via the inverter unit. The rotor position detection unit sends a rotor position signal of the permanent magnet synchronous motor in the absence of a motor controller to the HVAC microprocessor. The HVAC microprocessor controls the compressor motor and the centrifugal blower motor via the two relays and the drive circuits thereof.

Example 4

Figure 11:
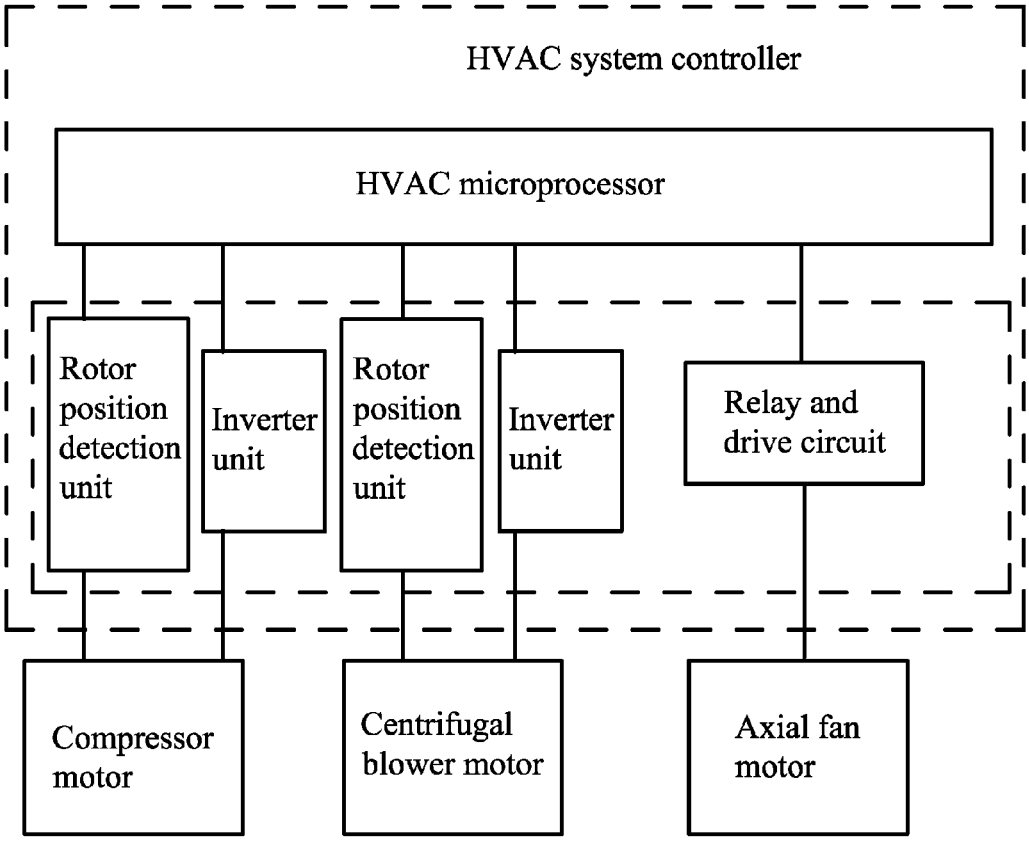
FIG. 11 is a fourth specific block diagram of FIG. 6.

As shown in FIG. 11, an HVAC control system is the same as that of Example 1 except that the compressor motor and the centrifugal blower motor are the permanent magnet synchronous motors in the absence of a motor controller while the axial fan motor is the AC motor. The interface unit for motor control comprises: two inverter units, two rotor position detection units, and a relay and a drive circuit thereof. The HVAC microprocessor drives the permanent magnet synchronous motors in the absence of a motor controller via the inverter units. The rotor position detection units send rotor position signals of the permanent magnet synchronous motors in the absence of a motor controller to the HVAC microprocessor. The HVAC microprocessor controls the axial fan motor via the relay and the drive circuit thereof.

Example 5

Figure 12:
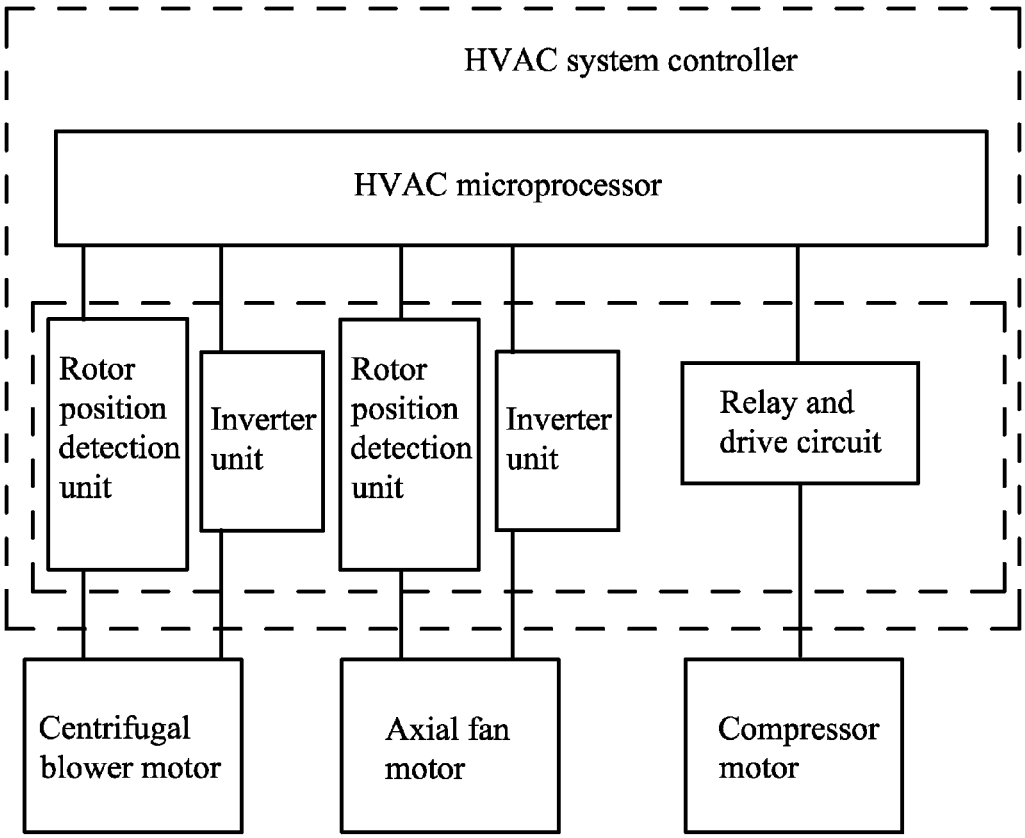
FIG. 12 is a fifth specific block diagram of FIG. 6.

As shown in FIG. 12, an HVAC control system is the same as that of Example 1 except that the axial fan motor and the centrifugal blower motor are the permanent magnet synchronous motors in the absence of a motor controller while the compressor motor is the AC motor. The interface unit for motor control comprises: two inverter units, two rotor position detection units, and a relay and a drive circuit thereof. The HVAC microprocessor drives the permanent magnet synchronous motors in the absence of a motor controller via the inverter units, respectively. The rotor position detection units send rotor position signals of the permanent magnet synchronous motors in the absence of a motor controller to the HVAC microprocessor, respectively. The HVAC microprocessor controls the compressor motor via the relay and the drive circuit thereof.

Example 6

Figure 13:
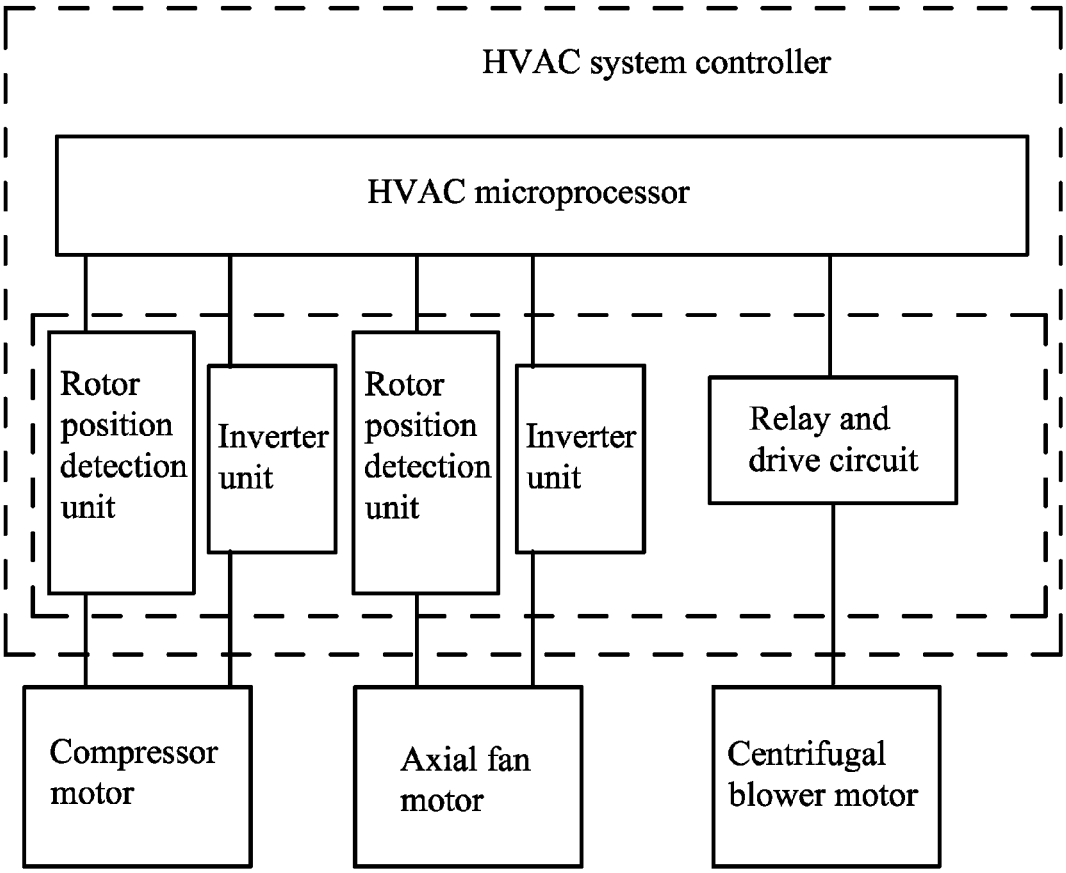
FIG. 13 is a sixth specific block diagram of FIG. 6.

As shown in FIG. 13, an HVAC control system is the same as that of Example 1 except that the axial fan motor and the compressor motor are the permanent magnet synchronous motors in the absence of a motor controller while the centrifugal blower motor is the AC motor. The interface unit for motor control comprises: two inverter units, two rotor position detection units, and a relay and a drive circuit thereof. The HVAC microprocessor drives the permanent magnet synchronous motors in the absence of a motor controller via the inverter units, respectively. The rotor position detection units send rotor position signals of the permanent magnet synchronous motors in the absence of a motor controller to the HVAC microprocessor, respectively. The HVAC microprocessor controls the centrifugal blower motor via the relay and the drive circuit thereof.

Example 7

Figure 14:
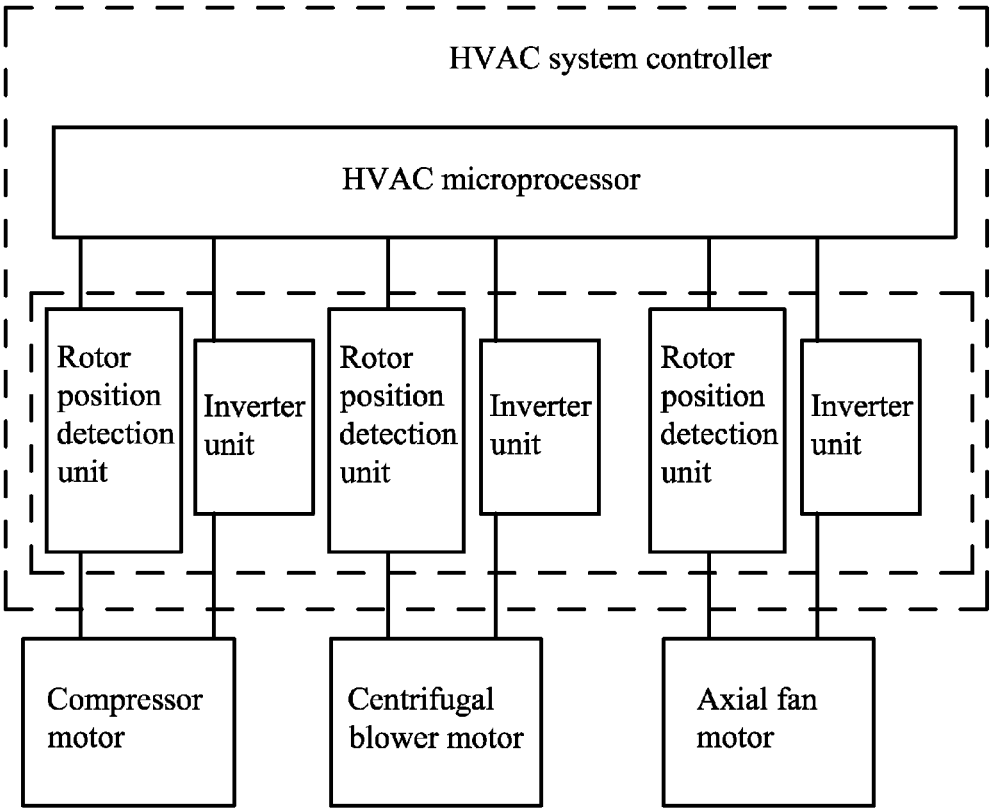
FIG. 14 is a seventh specific block diagram of FIG. 6.

As shown in FIG. 14, an HVAC control system is the same as that of Example 6 except that the axial fan motor, the compressor motor, and the centrifugal blower motor are all the permanent magnet synchronous motors in the absence of a motor controller. The interface unit for motor control comprises: three inverter units and three rotor position detection units. The HVAC microprocessor drives the permanent magnet synchronous motors in the absence of a motor controller via the inverter units, respectively. The rotor position detection units send rotor position signals of the permanent magnet synchronous motors in the absence of a motor controller to the HVAC microprocessor, respectively.

Example 8

Figure 15:
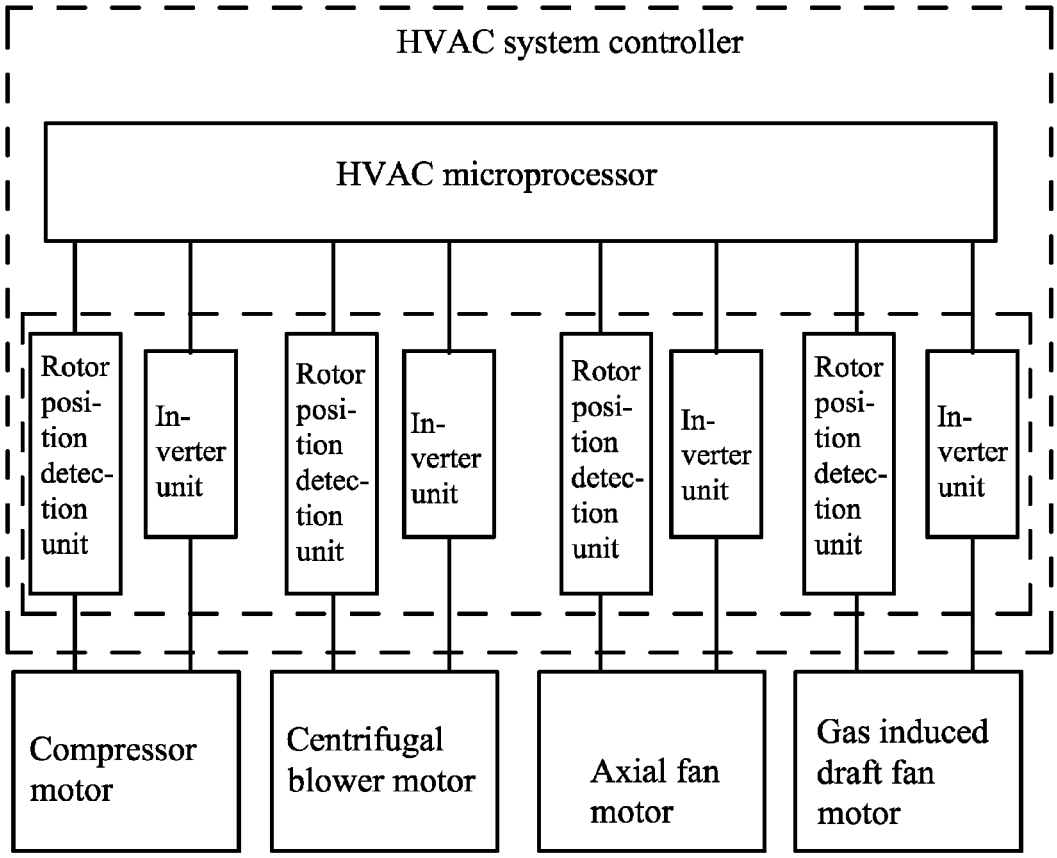
FIG. 15 is an eighth specific block diagram of FIG. 6.

As shown in FIG. 15, an HVAC control system is the same as that of Example 7 except that the HVAC control system is further connected to a gas induced draft fan motor besides the centrifugal blower motor, the compressor motor, and the axial fan motor. The gas induced draft fan motor, the centrifugal blower motor, the compressor motor, and the axial fan motor are all the permanent magnet synchronous motors in the absence of a motor controller. The interface unit for motor control comprises: four inverter units and four rotor position detection units. The HVAC microprocessor drives the permanent magnet synchronous motors in the absence of a motor controller via the inverter units, respectively. The rotor position detection units send rotor position signals of the permanent magnet synchronous motors in the absence of a motor controller to the HVAC microprocessor, respectively.

Example 9

Figure 16:
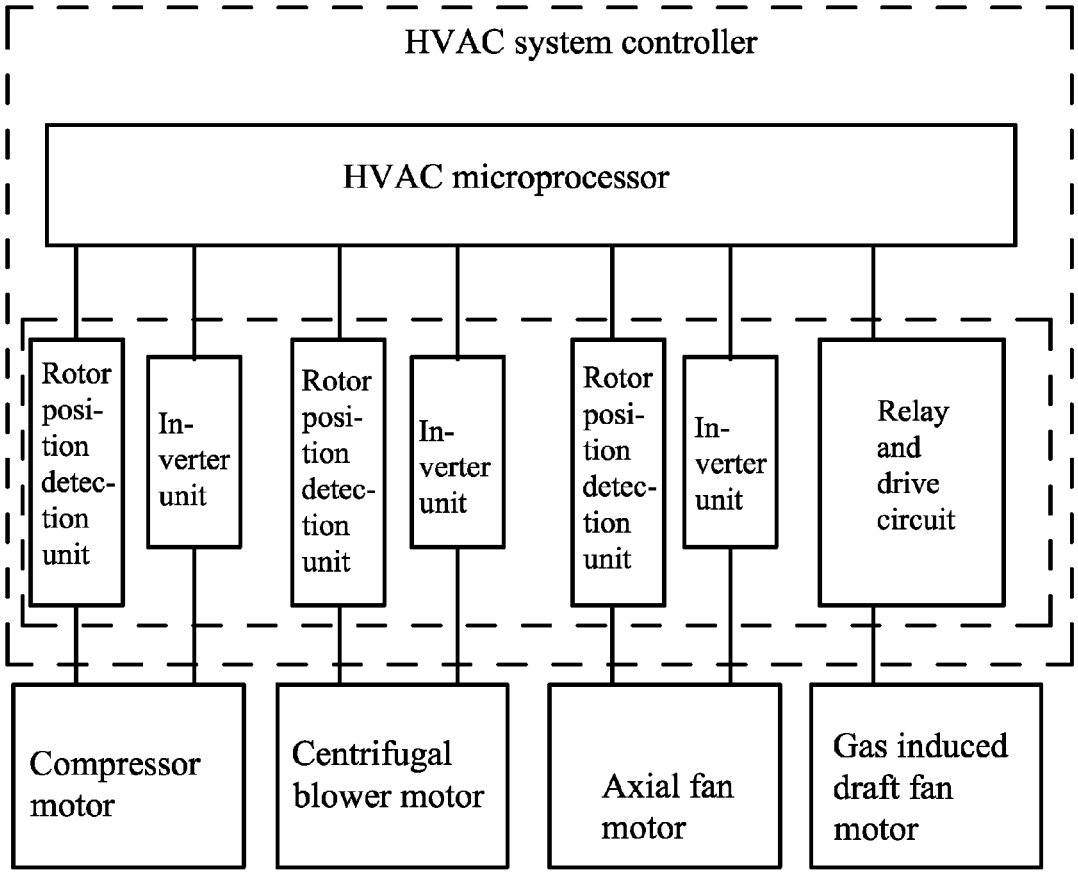
FIG. 16 is a ninth specific block diagram of FIG. 6.

As shown in FIG. 16, an HVAC control system is the same as that of Example 7 except that the HVAC control system is further connected to a gas induced draft fan motor besides the centrifugal blower motor, the compressor motor, and the axial fan motor. The centrifugal blower motor, the compressor motor, and the axial fan motor are the permanent magnet synchronous motors in the absence of a motor controller while the gas induced draft fan motor is the AC motor. The interface unit for motor control comprises: three inverter units, three rotor position detection units, and a relay and a drive circuit thereof. The HVAC microprocessor drives the permanent magnet synchronous motors in the absence of a motor controller via the inverter units, respectively. The rotor position detection units send rotor position signals of the permanent magnet synchronous motors in the absence of a motor controller to the HVAC microprocessor, respectively. The HVAC microprocessor controls the gas induced draft fan motor via the relay and the drive circuit thereof.

Example 10

Figure 17:
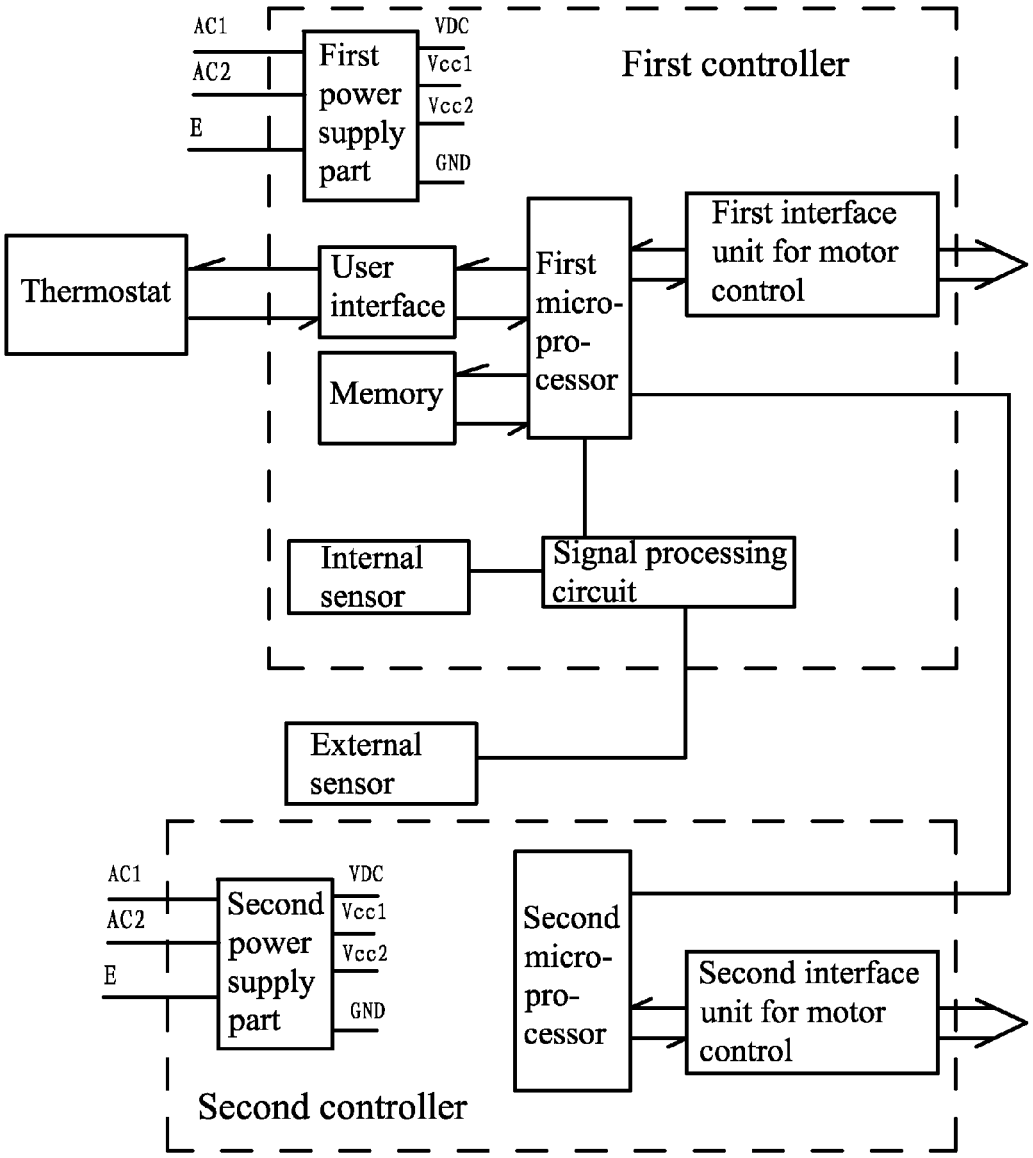
FIG. 17 is a second circuit block diagram of an HVAC control system for a household central air conditioning according to one embodiment of the invention.
Figure 18:
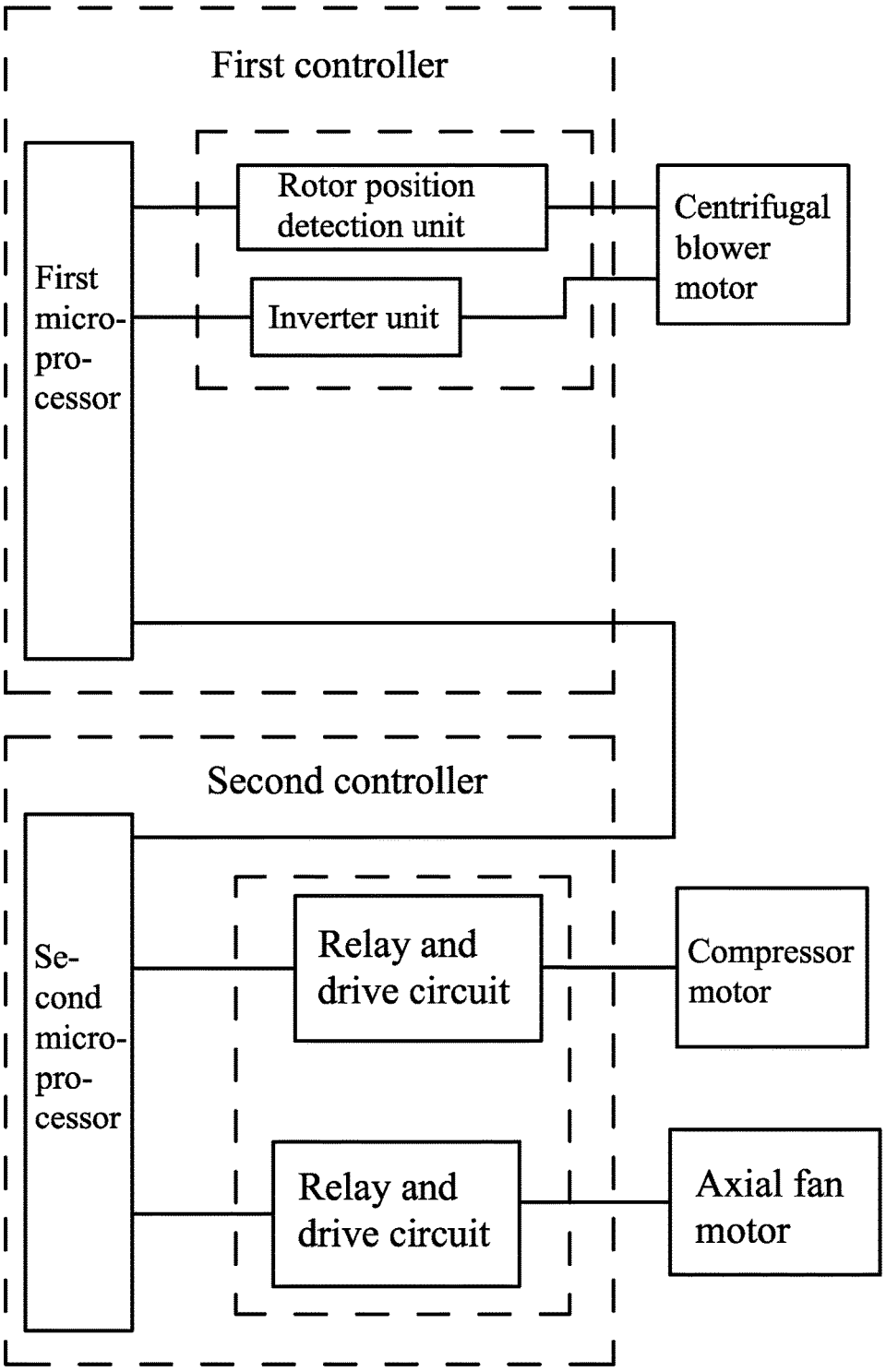
FIG. 18 is a first specific block diagram of FIG. 17.

As shown in FIGS. 17-18, an HVAC control system for household air conditioning comprises: a first controller for indoor unit, a second controller for outdoor unit, a centrifugal blower motor, a compressor motor, and an axial fan motor. The firs controller comprises: a first microprocessor, an internal sensor, an external sensor, a memory, a signal processing circuit, a user interface, a first interface unit for motor control, and a first power supply part. The first power supply part supplies power to each circuit part of the first controller. The internal sensor and the external sensor send detected signals to the first microprocessor via the signal processing circuit. A thermostat is connected to the first microprocessor via the user interface for communication. The second controller comprises: a second microprocessor, a second interface unit for motor control, and a second power supply part. The second power supply part supplies power to each circuit part of the second controller. The second microprocessor controls the compressor motor and the axial fan motor via the second interface unit for motor control. The first microprocessor controls the centrifugal blower motor via the first interface unit for motor control. The centrifugal blower motor is a permanent magnet synchronous motor in the absence of a motor controller; and the compressor motor and the axial fan motor are AC motors. The first interface unit for motor control comprises a first inverter unit and a first rotor position detection unit. The first microprocessor drives the permanent magnet synchronous motor in the absence of a motor controller via the first inverter unit. The first rotor position detection unit sends a rotor position signal of the permanent magnet synchronous motor in the absence of a motor controller to the first microprocessor. The second interface unit for motor control comprises two second relays and drive circuits thereof. The second microprocessor controls the compressor motor and the axial fan motor via the two second relays and the drive circuits thereof.

Figure 19:
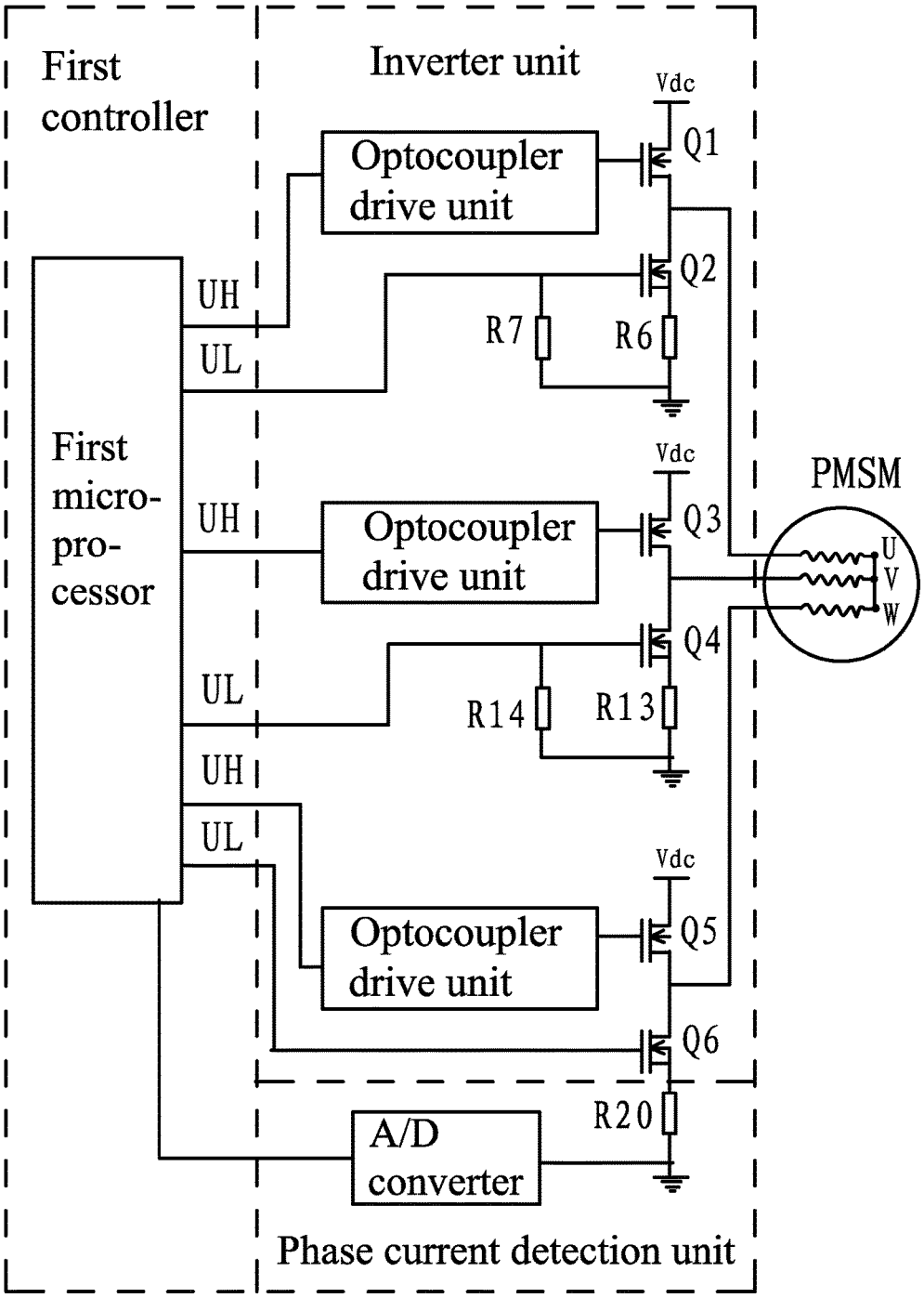
FIG. 19 is a second circuit diagram showing an inverter unit and a rotor position detection unit of an HVAC control system according to one embodiment of the invention.

As shown in FIG. 19, the permanent magnet synchronous motor in the absence of a motor controller is controlled by the first microprocessor. The first rotor position detection unit is a phase current detection unit. The phase current detection unit primarily comprises a resistance R20 and an A/D converter. A vector control mode without position sensor is employed to only detect the phase current of a motor winding and calculate the rotor position. A plurality of IGBT switches Q1, Q2, Q3, Q4, Q5, and Q6 of the inverter circuit are utilized to control the current of the motor winding. Therefore, the circuit structure and the connection are simplified, the detected signals are decreased, and the production cost is further reduced.

Example 11

Figure 20:
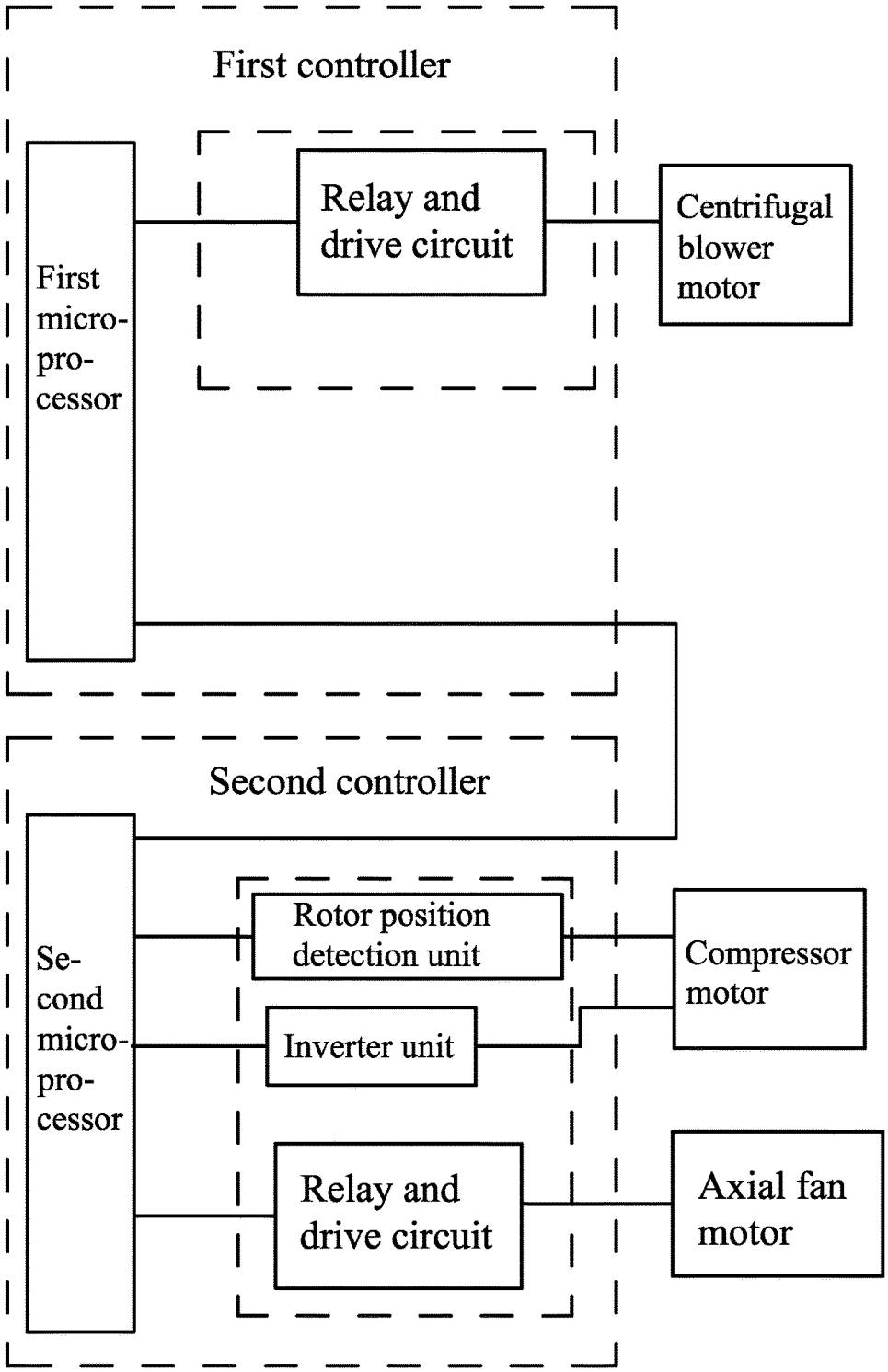
FIG. 20 is a second specific block diagram of FIG. 17.

As shown in FIG. 20, the HVAC control system is the same as that of Example 10 except that the compressor motor is the permanent magnet synchronous motor in the absence of a motor controller while the centrifugal blower motor and the axial fan motor are the AC motors. The first interface unit for motor control comprises a first relay and a drive circuit thereof. The first microprocessor controls the centrifugal blower motor via the first relay and the drive circuit thereof. The second interface unit for motor control comprises: a second relay and a drive circuit thereof, a second inverter unit, and a second rotor position detection unit. The second microprocessor controls the axial fan motor via the second relay and the drive circuit thereof and drives the compressor motor via the second inverter unit. The second rotor position detection unit sends a rotor position signal of the compressor motor to the second microprocessor.

Example 12

Figure 21:
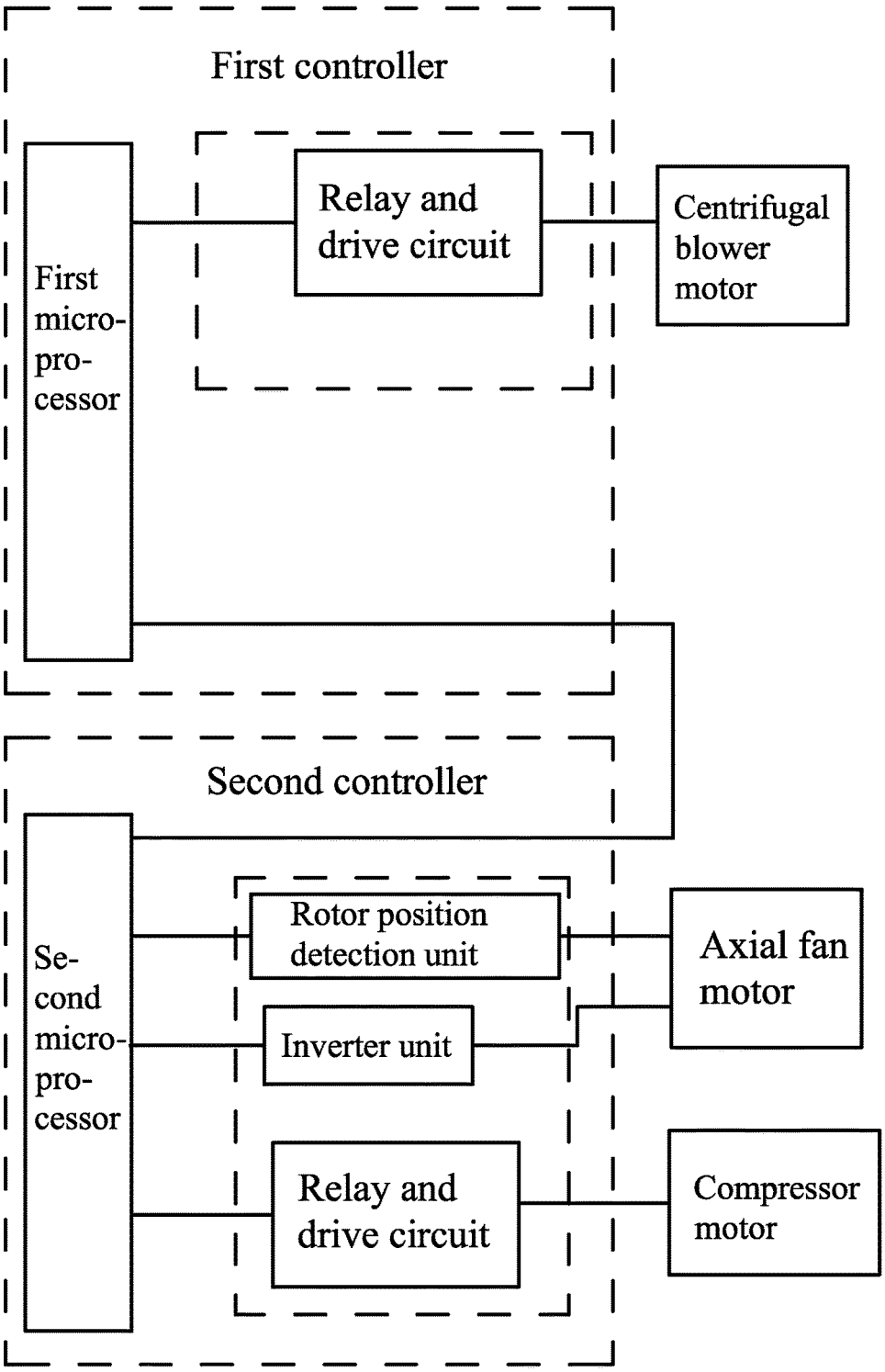
FIG. 21 is a third specific block diagram of FIG. 17.

As shown in FIG. 21, the HVAC control system is the same as that of Example 11 except that the axial fan motor is the permanent magnet synchronous motor in the absence of a motor controller, the compressor motor and the centrifugal blower motor are the AC motors. The first interface unit for motor control comprises a first relay and a drive circuit thereof. The first microprocessor controls the centrifugal blower motor via the first relay and the drive circuit thereof. The second interface unit for motor control comprises: a second relay and a drive circuit thereof, a second inverter unit, and a second rotor position detection unit. The second microprocessor controls the compressor via the second relay and the drive circuit thereof and drives the axial fan motor via the second inverter unit. The second rotor position detection unit sends a rotor position signal of the axial fan motor to the second microprocessor.

Example 13

Figure 22:
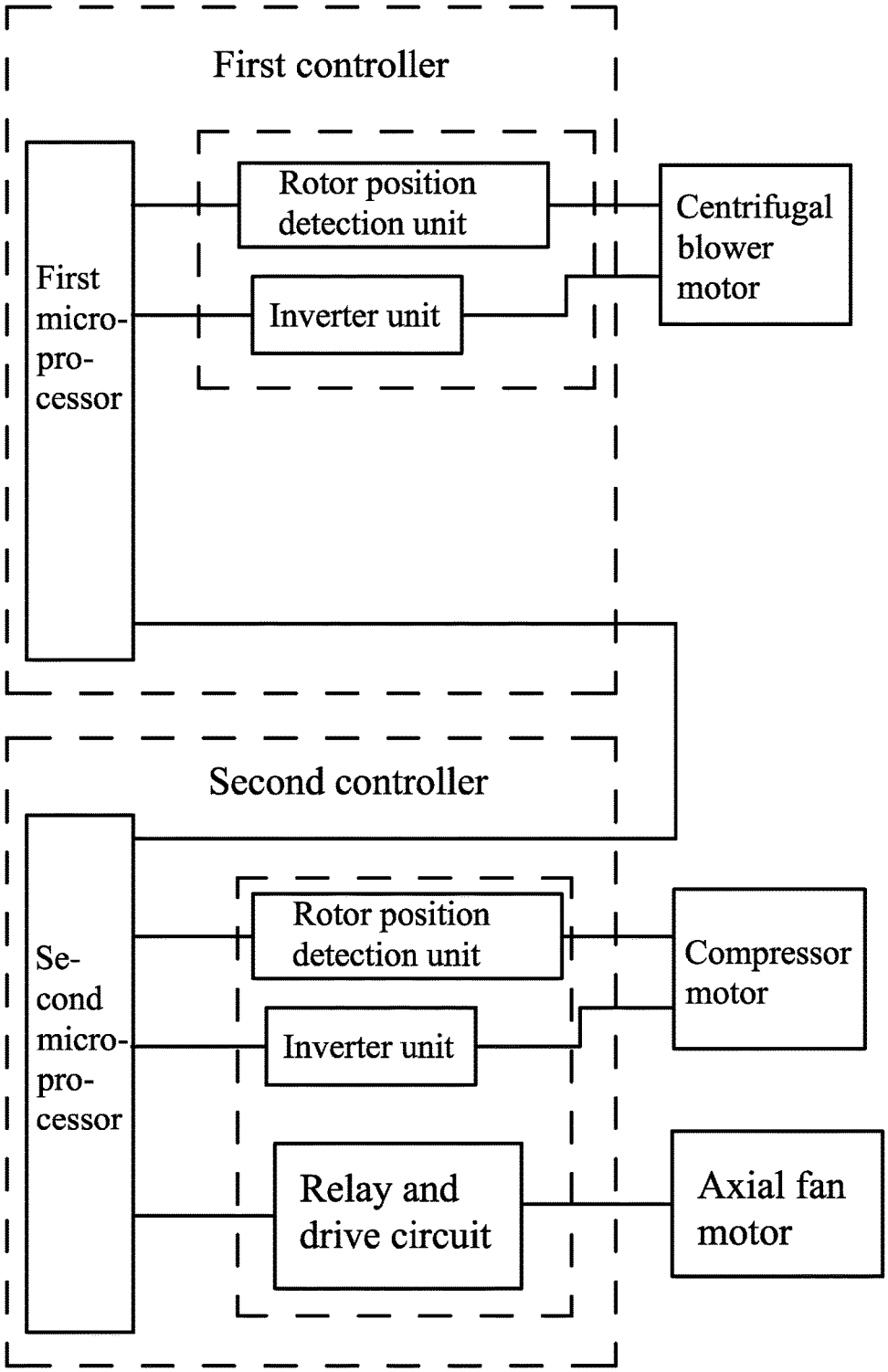
FIG. 22 is a fourth specific block diagram of FIG. 17.

As shown in FIG. 22, the HVAC control system is the same as that of Example 10 except that the compressor motor, the centrifugal blower motor, and the axial fan motor are all permanent magnet synchronous motors in the absence of a motor controller. The first interface unit for motor control comprises a first inverter unit and a first rotor position detection unit. The first microprocessor drives the centrifugal blower motor via the first inverter unit. The first rotor position detection unit sends a rotor position signal of the centrifugal blower motor to the first microprocessor. The second interface unit for motor control comprises: a second relay and a drive circuit thereof, a second inverter unit, and a second rotor position detection unit. The second microprocessor controls the axial fan motor via the second relay and the drive circuit thereof and drives the compressor motor via the second inverter unit. The second rotor position detection unit sends a rotor position signal of the compressor motor to the second microprocessor.

Example 14

Figure 23:
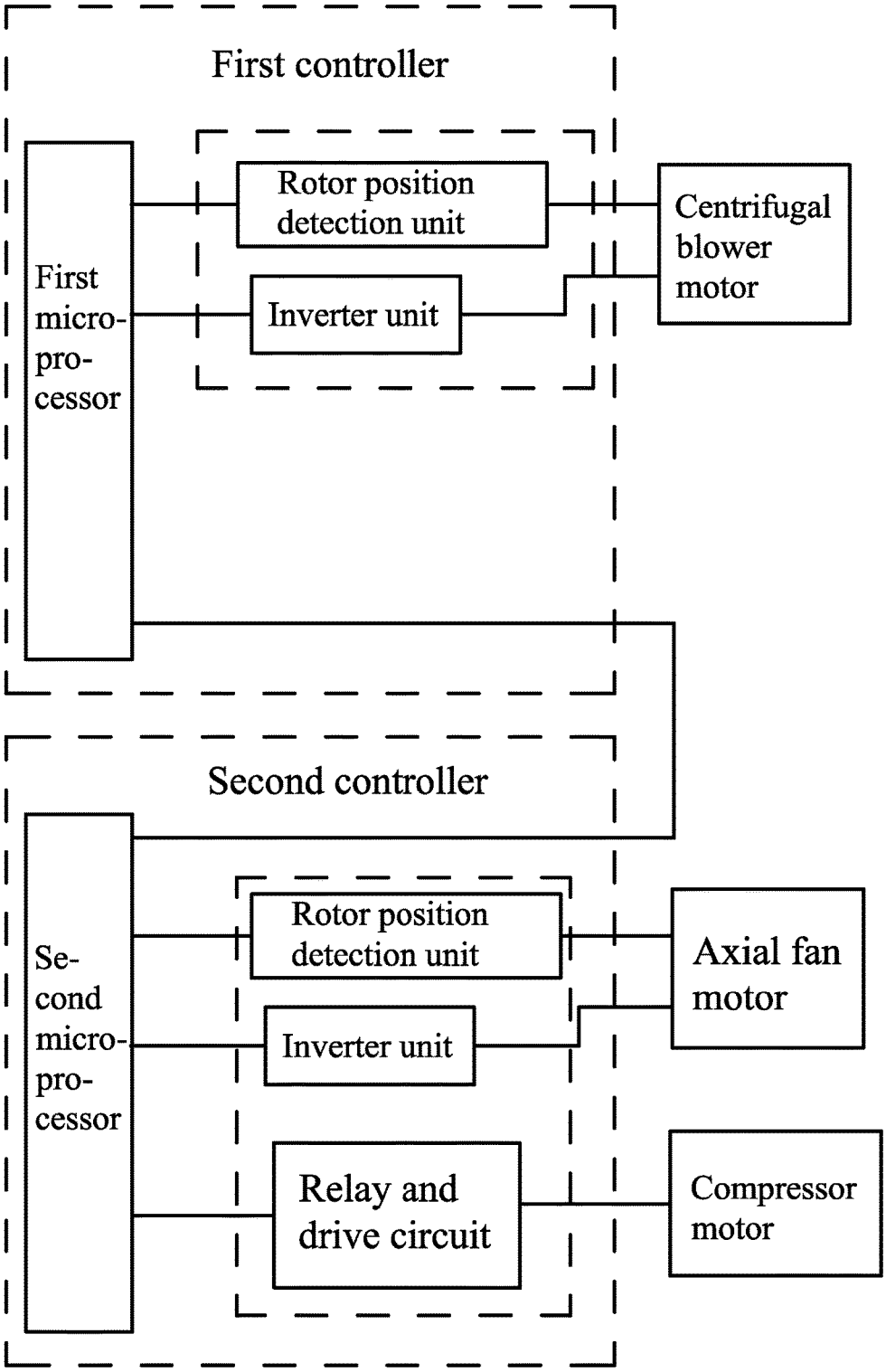
FIG. 23 is a fifth specific block diagram of FIG. 17.

As shown in FIG. 23, the HVAC control system is the same as that of Example 13 except that the axial fan motor and the centrifugal blower motor are permanent magnet synchronous motors in the absence of a motor controller; and the compressor motor is the AC motor. The first interface unit for motor control comprises a first inverter unit and a first rotor position detection unit. The first microprocessor drives the centrifugal blower motor via the first inverter unit. The first rotor position detection unit sends a rotor position signal of the centrifugal blower motor to the first microprocessor. The second interface unit for motor control comprises: a second relay and a drive circuit thereof, a second inverter unit, and a second rotor position detection unit. The second microprocessor controls the compressor motor via the second relay and the drive circuit thereof and drives the axial fan motor via the second inverter unit. The second rotor position detection unit sends a rotor position signal of the axial fan motor to the second microprocessor.

Example 15

Figure 24:
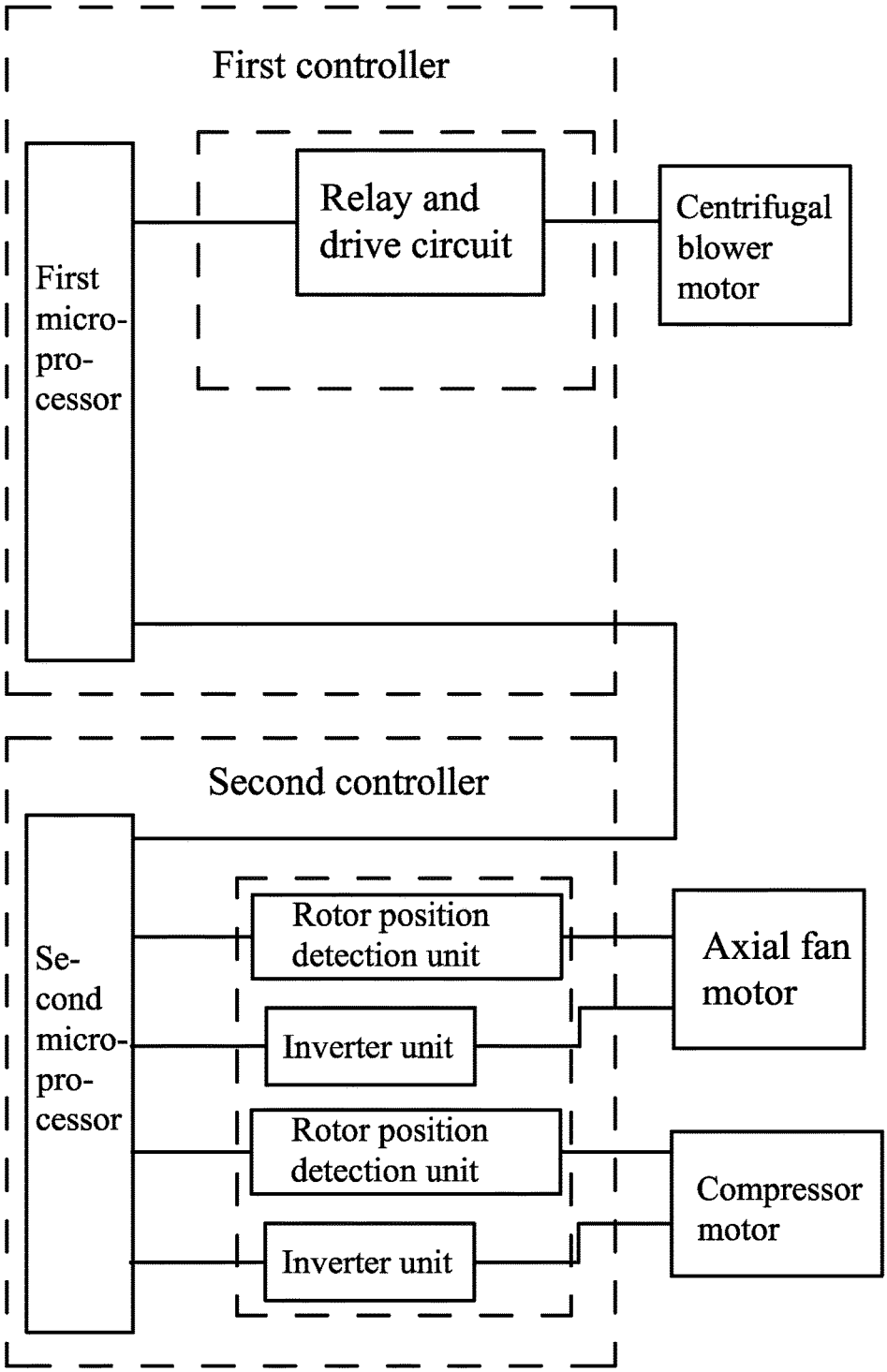
FIG. 24 is a sixth specific block diagram of FIG. 17.

As shown in FIG. 24, the HVAC control system is the same as that of Example 14 except that the axial fan motor and the compressor motor are permanent magnet synchronous motors in the absence of a motor controller; and the centrifugal blower motor is the AC motor. The first interface unit for motor control comprises a first relay and a drive circuit thereof. The first microprocessor controls the centrifugal blower motor via the first relay and the drive circuit thereof. The second interface unit for motor control comprises: two second inverter units and two second rotor position detection units. The second microprocessor drives the compressor motor and the axial fan motor via the two second inverter units, respectively. The two second rotor position detection units send rotor position signals of axial fan motor and the compressor motor to the second microprocessor, respectively.

Example 16

Figure 25:
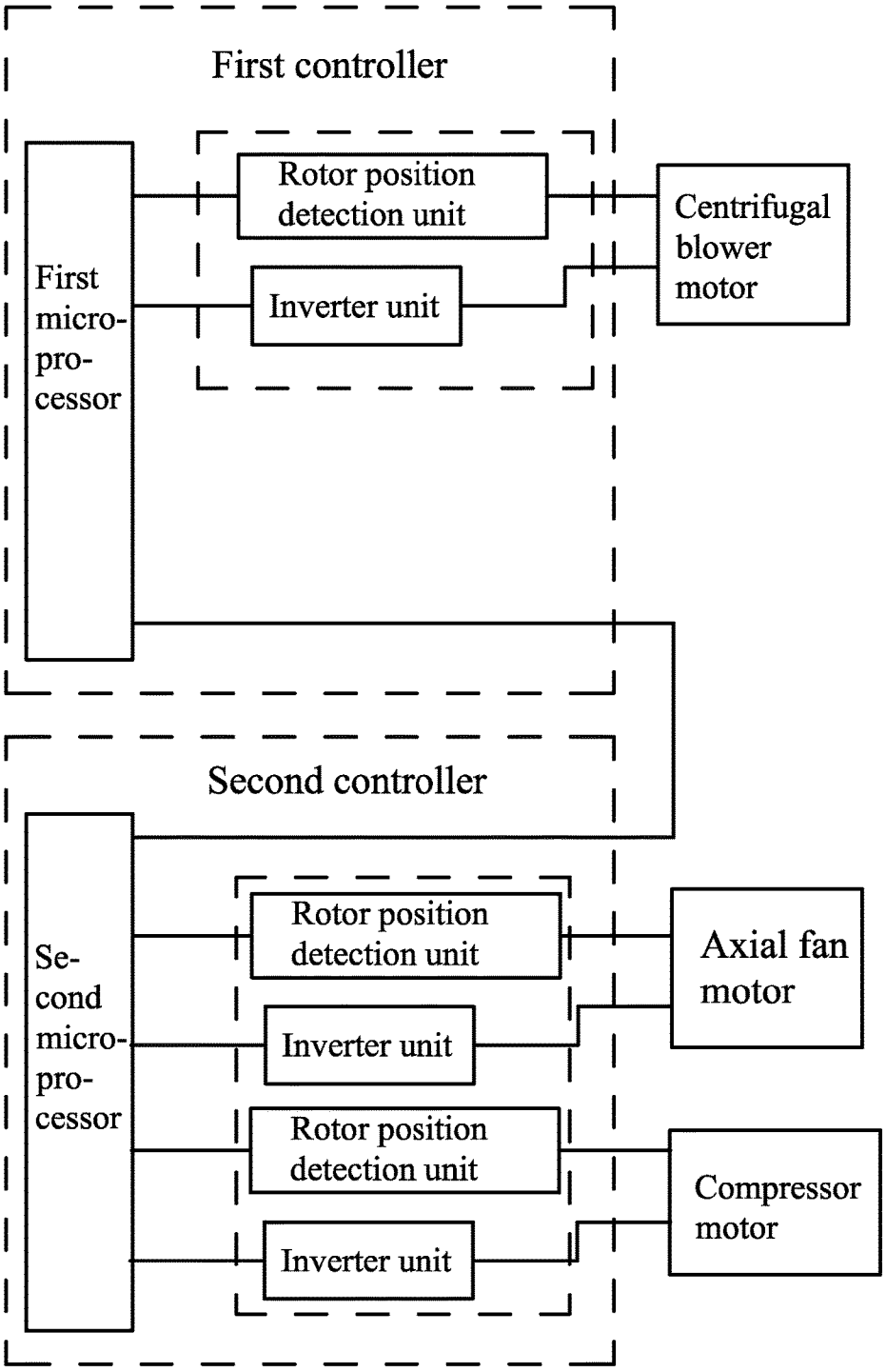
FIG. 25 is a seventh specific block diagram of FIG. 17.

As shown in FIG. 25, the HVAC control system is the same as that of Example 15 except that the centrifugal blower motor, the axial fan motor, and the compressor motor are all permanent magnet synchronous motors in the absence of a motor controller. The first interface unit for motor control comprises a first inverter unit and a first rotor position detection unit. The first microprocessor drives the centrifugal blower motor via the first inverter unit. The first rotor position detection unit sends a rotor position signal of the centrifugal blower motor to the first microprocessor. The second interface unit for motor control comprises: two second inverter units and two second rotor position detection units. The second microprocessor drives the compressor motor and the axial fan motor via the two second inverter units, respectively. The two second rotor position detection units send rotor position signals of axial fan motor and the compressor motor to the second microprocessor, respectively.

Example 17

Figure 26:
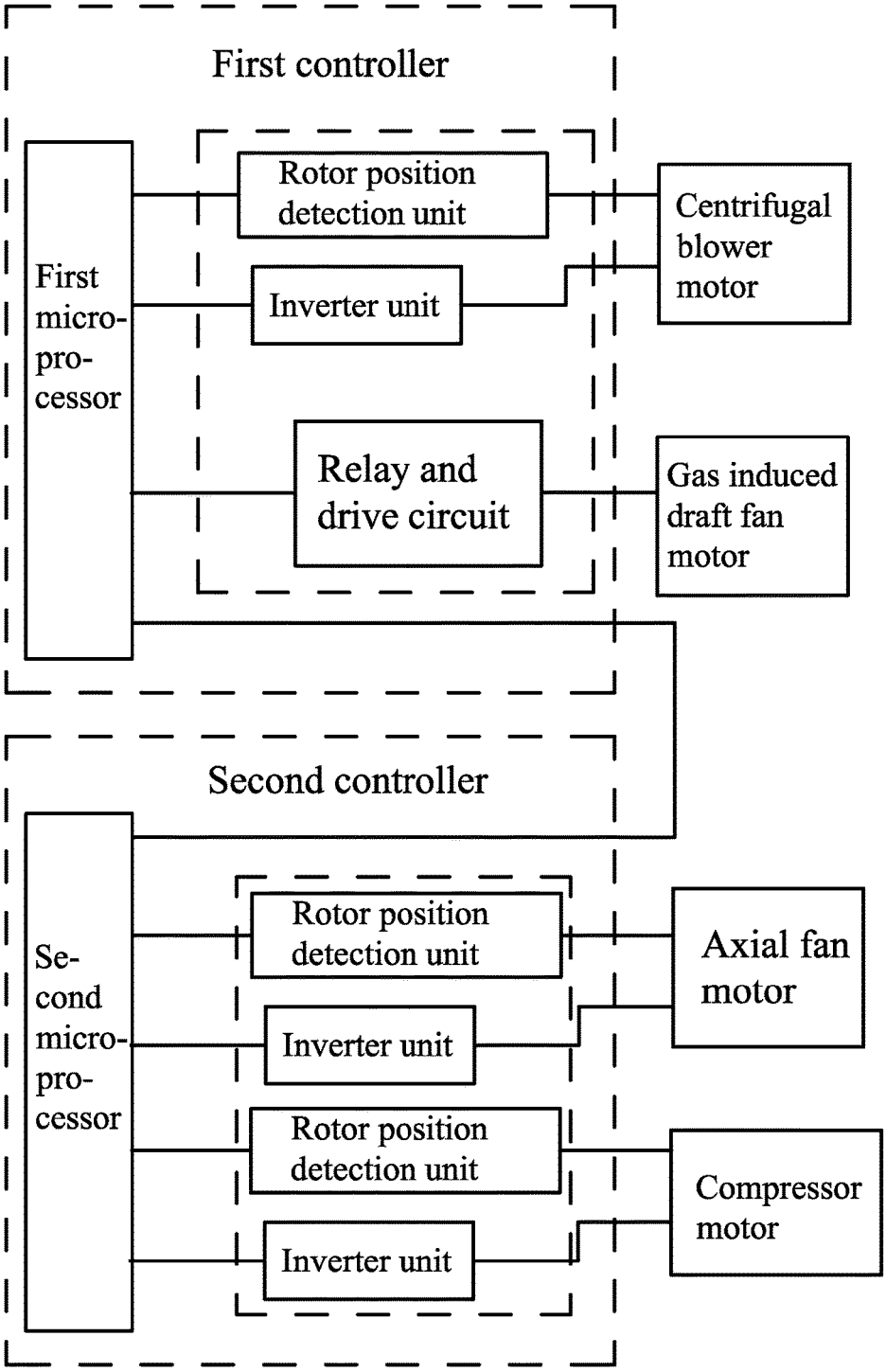
FIG. 26 is an eighth specific block diagram of FIG. 17.

As shown in FIG. 26, the HVAC control system is the same as that of Example 16 except that the first microprocessor is further connected to a gas induced draft fan motor. The centrifugal blower motor, the axial fan motor, and the compressor motor are all permanent magnet synchronous motors in the absence of a motor controller; and the gas induced draft fan motor is the AC motor. The first interface unit for motor control comprises: a first inverter unit, a first rotor position detection unit, and a first relay and a drive circuit thereof. The first microprocessor drives the centrifugal blower motor via the first inverter unit. The first rotor position detection unit sends a rotor position signal of the centrifugal blower motor to the first microprocessor. The first microprocessor controls the gas induced draft fan motor via the first relay and the drive circuit thereof. The second interface unit for motor control comprises: two second inverter units and two second rotor position detection units. The second microprocessor drives the compressor motor and the axial fan motor via the two second inverter units, respectively. The two second rotor position detection units send rotor position signals of axial fan motor and the compressor motor to the second microprocessor, respectively.

Example 18

Figure 27:
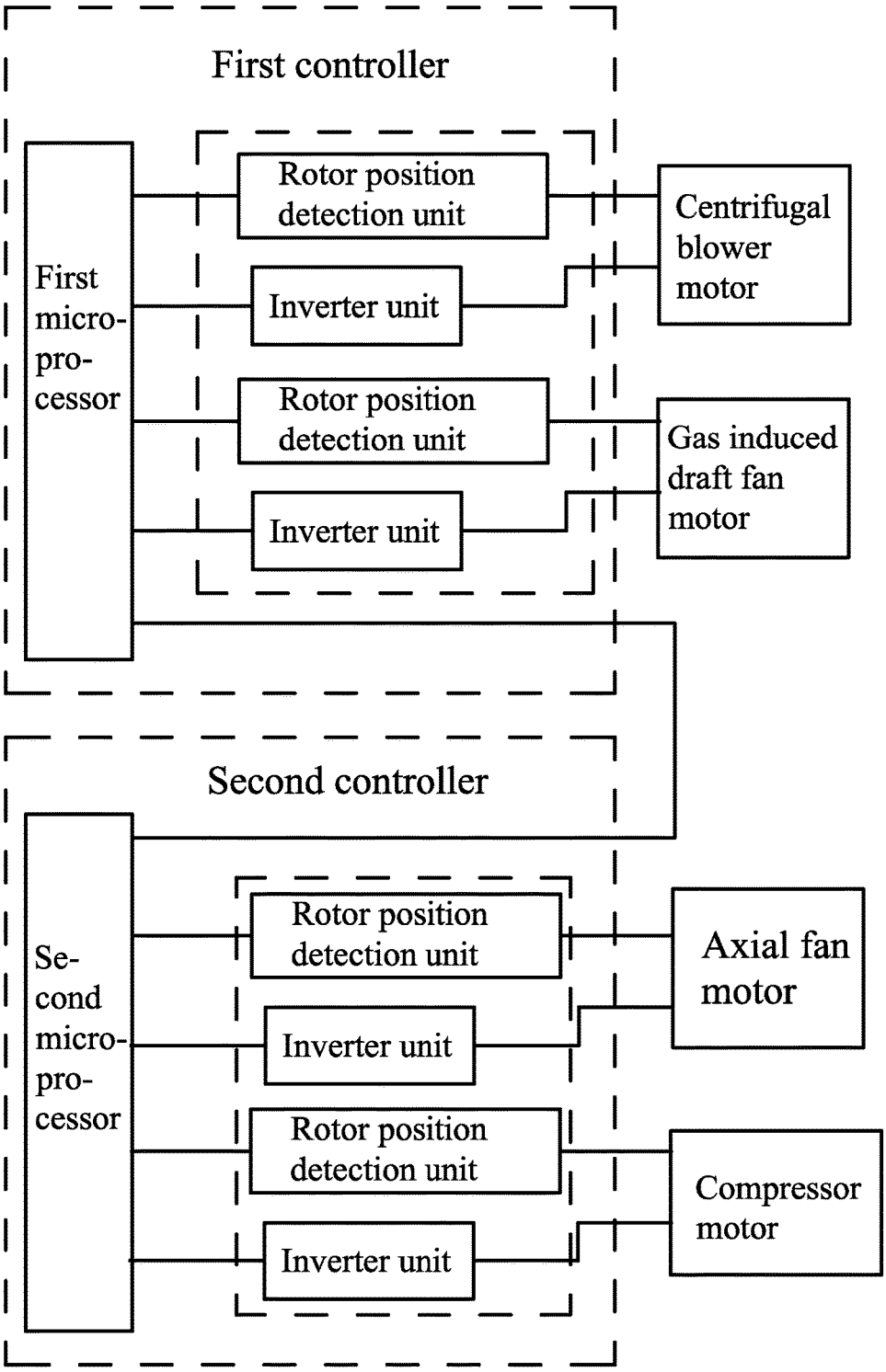
FIG. 27 is a ninth specific block diagram of FIG. 17.

As shown in FIG. 27, the HVAC control system is the same as that of Example 17 except that the first microprocessor is further connected to a gas induced draft fan motor. The gas induced draft fan motor, the centrifugal blower motor, the axial fan motor, and the compressor motor are all permanent magnet synchronous motors in the absence of a motor controller. The first interface unit for motor control comprises: two first inverter units and two first rotor position detection units. The first microprocessor drives the centrifugal blower motor and the gas induced draft fan motor via the two first inverter units, respectively. The two first rotor position detection units send rotor position signals of the centrifugal blower motor and the gas induced draft fan motor to the first microprocessor. The second interface unit for motor control comprises: two second inverter units and two second rotor position detection units. The second microprocessor drives the compressor motor and the axial fan motor via the two second inverter units, respectively. The two second rotor position detection units send rotor position signals of axial fan motor and the compressor motor to the second microprocessor, respectively.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An HVAC control system for a household central air conditioning, comprising:

a) an HVAC system controller, the HVAC system controller comprising an HVAC microprocessor, an internal sensor, an external sensor, a housing, an interface unit for motor control, a power supply part, and a signal processing circuit; the interface unit for motor control comprising a first motor control assembly and a second motor control assembly; the first motor control assembly comprising a first inverter unit and a first rotor position detection unit; and the second motor control assembly comprising a relay and a drive circuit;

b) a centrifugal blower motor;

c) a compressor motor; and d) an axial fan motor;

wherein the power supply part supplies power to each circuit part;

the internal sensor is disposed within the housing;

the external sensor is disposed outside of the housing;

each of the internal sensor and the external sensor sends a detected signal to the HVAC microprocessor via the signal processing circuit;

one of the centrifugal blower motor, the compressor motor, and the axial fan motor is a permanent magnet synchronous motor, and each of the remaining two of the centrifugal blower motor, the compressor motor, and the axial fan motor is an AC motor; wherein the permanent magnet synchronous motor does not comprise a motor controller;

the HVAC system controller is spatially separated from the permanent magnet synchronous motor;

the HVAC microprocessor controls the AC motor via the relay and the drive circuit;

the HVAC microprocessor drives the permanent magnet synchronous motor via the first inverter unit;

the first rotor position detection unit is connected to the permanent magnet synchronous motor; and the first rotor position detection unit is adapted to detect a rotor position signal of the permanent magnet synchronous motor, and to send the rotor position signal to the HVAC microprocessor.

2. The system of claim 1, wherein two of the centrifugal blower motor, the compressor motor, and the axial fan motor are the permanent magnet synchronous motors, and the remaining one of the centrifugal blower motor, the compressor motor, and the axial fan motor is the AC motor;

the first motor control assembly further comprises a second inverter unit and a second rotor position detection unit;

the HVAC microprocessor drives the permanent magnet synchronous motors via the first inverter unit and the second inverter unit;

each of the first rotor position detection unit and the second rotor position detection unit is connected to one of the permanent magnet synchronous motors; and each of the first rotor position detection unit and the second rotor position detection unit is adapted to detect a rotor position signal of one of the permanent magnet synchronous motors, and to send the rotor position signal to the HVAC microprocessor.

3. The system of claim 1, wherein all of the centrifugal blower motor, the axial fan motor, and the compressor motor are the permanent magnet synchronous motors;

the first motor control assembly further comprises a second inverter unit, a third inverter unit, a second rotor position detection unit, and a third rotor position detection unit;

the HVAC microprocessor drives the permanent magnet synchronous motors via the first inverter unit, the second inverter unit, and the third inverter unit;

each of the first rotor position detection unit, the second rotor position detection unit, and the third rotor position detection unit is connected to one of the permanent magnet synchronous motors; and each of the first rotor position detection unit, the second rotor position detection unit, and the third rotor position detection unit is adapted to detect a rotor position signal of one of the permanent magnet synchronous motors, and to send the rotor position signal to the HVAC microprocessor.

4. The system of claim 1, wherein the first rotor position detection unit is a phase current detection circuit.

5. An HVAC control system for a household central air conditioning, comprising:

a) a first controller for an indoor unit, the first controller comprising: a first microprocessor, an internal sensor, an external sensor, a housing, a first interface unit for motor control, a first power supply part, and a signal processing circuit;

b) a second controller for an outdoor unit, the second controller comprising: a second microprocessor, a second interface unit for motor control, and a second power supply part;

c) a centrifugal blower motor;

d) a compressor motor; and e) an axial fan motor;

wherein the first power supply part supplies power to each circuit part of the first controller;

the internal sensor is disposed within the housing;

the external sensor is disposed outside of the housing;

each of the internal sensor and the external sensor sends a detected signal to the first microprocessor via the signal processing circuit;

the second power supply part supplies power to each circuit part of the second controller;

the second microprocessor controls the compressor motor and the axial fan motor via the second interface unit for motor control;

the first microprocessor controls the centrifugal blower motor via the first interface unit for motor control;

the first interface unit for motor control or the second interface unit for motor control comprises a first motor control assembly and a second motor control assembly; the first motor control assembly comprises a first inverter unit and a first rotor position detection unit; and the second motor control assembly comprises a relay and a drive circuit;

one of the centrifugal blower motor, the compressor motor, and the axial fan motor is a permanent magnet synchronous motor, and each of the remaining two of the centrifugal blower motor, the compressor motor, and the axial fan motor is an AC motor; wherein the permanent magnet synchronous motor does not comprise a motor controller;

the first controller and the second controller are spatially separated from the permanent magnet synchronous motor;

the first microprocessor or the second microprocessor controls the AC motor via the relay and the drive circuit;

the first microprocessor or the second microprocessor drives the permanent magnet synchronous motor via the first inverter unit;

the first rotor position detection unit is connected to the permanent magnet synchronous motor; and the first rotor position detection unit is adapted to detect a rotor position signal of the permanent magnet synchronous motor, and to send the rotor position signal to the first microprocessor or the second microprocessor.

6. The system of claim 5, wherein two of the centrifugal blower motor, the compressor motor, and the axial fan motor are the permanent magnet synchronous motors, and the remaining one of the centrifugal blower motor, the compressor motor, and the axial fan motor is the AC motor;

the first motor control assembly further comprises a second inverter unit and a second rotor position detection unit;

the first microprocessor and/or the second microprocessor drive/drives the permanent magnet synchronous motors via the first inverter unit and the second inverter unit;

each of the first rotor position detection unit and the second rotor position detection unit is connected to one of the permanent magnet synchronous motors; and each of the first rotor position detection unit and the second rotor position detection unit is adapted to detect a rotor position signal of one of the permanent magnet synchronous motors, and to send the rotor position signal to the first microprocessor and/or the second microprocessor.

7. The system of claim 5, wherein all of the centrifugal blower motor, the axial fan motor, and the compressor motor are the permanent magnet synchronous motors;

the first motor control assembly further comprises a second inverter unit and a second rotor position detection unit;

the first motor control assembly further comprises a third inverter unit and a third rotor position detection unit;

the first microprocessor and/or the second microprocessor drive/drives the permanent magnet synchronous motors via the first inverter unit, the second inverter unit, and the third inverter unit;

each of the first rotor position detection unit, the second rotor position detection unit, and the third rotor position detection unit is connected to one of the permanent magnet synchronous motors; and each of the first rotor position detection unit, the second rotor position detection unit, and the third rotor position detection unit is adapted to detect a rotor position signal of one of the permanent magnet synchronous motors, and to send the rotor position signal to the first microprocessor and/or the second microprocessor.

8. The system of claim 5, wherein the first rotor position detection unit is a phase current detection circuit.

9. The system of claim 2, wherein each of the first rotor position detection unit and the second rotor position detection unit is a phase current detection circuit.

10. The system of claim 3, wherein each of the first rotor position detection unit, the second rotor position detection unit, and the third rotor position detection unit is a phase current detection circuit.

11. The system of claim 6, wherein each of the first rotor position detection unit and the second rotor position detection unit is a phase current detection circuit.

12. The system of claim 7, wherein each of the first rotor position detection unit, the second rotor position detection unit, and the third rotor position detection unit is a phase current detection circuit.

* * * * *